US007949421B2

(12) United States Patent
Hayakawa et al.

(10) Patent No.: US 7,949,421 B2
(45) Date of Patent: May 24, 2011

(54) MULTI-NEEDLE TYPE EMBROIDERY SEWING MACHINE AND COMPUTER-READABLE STORAGE MEDIUM INCLUDING A COMPUTER CONTROL PROGRAM FOR THE MULTI-NEEDLE TYPE EMBROIDERY SEWING MACHINE

(75) Inventors: Atsuya Hayakawa, Chita (JP); Akira Kaiya, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1001 days.

(21) Appl. No.: 11/819,256

(22) Filed: Jun. 26, 2007

(65) Prior Publication Data

US 2007/0295253 A1 Dec. 27, 2007

(30) Foreign Application Priority Data

Jun. 26, 2006 (JP) ..... 2006-175703

(51) Int. Cl.
*D05C 5/02* (2006.01)

(52) U.S. Cl. ..... 700/138; 112/102.5

(58) Field of Classification Search ..... 700/138, 700/137, 136; 112/470.06, 470.07, 470.19, 112/102.5, 155, 163
See application file for complete search history.

(56) References Cited

U.S. PATENT DOCUMENTS

| | | | | |
|---|---|---|---|---|
| 5,791,274 | A * | 8/1998 | Akahane et al. | 112/470.04 |
| 5,794,554 | A * | 8/1998 | Akahane et al. | 112/470.01 |
| 5,832,851 | A * | 11/1998 | Kato | 112/470.01 |
| 6,012,402 | A | 1/2000 | Sekine | |
| 6,698,369 | B2 * | 3/2004 | Kwak | 112/102.5 |
| 6,874,437 | B2 * | 4/2005 | Kim | 112/102.5 |
| 6,925,946 | B1 * | 8/2005 | Kang | 112/102.5 |
| 7,252,044 | B2 * | 8/2007 | Lee | 112/102.5 |

FOREIGN PATENT DOCUMENTS

| | | |
|---|---|---|
| JP | A 7-185158 | 7/1995 |
| JP | A 10-140460 | 5/1998 |

* cited by examiner

*Primary Examiner* — Danny Worrell
(74) *Attorney, Agent, or Firm* — Oliff & Berridge, PLC

(57) ABSTRACT

A multi-needle type embroidery sewing machine and a computer-readable storage medium including a computer program for the multi-needle type embroidery sewing machine that may enable convenient selection and replacement of thread information. The multi-needle type embroidery sewing machine may include a plurality of needle bars, a needle bar thread information storage device, a needle bar selection device that enables the selection of a suite of needle bars selected from the plurality of needle bars, and a control device for changing needle bar thread information that corresponds to a needle bar in the selected suite of needle bars.

20 Claims, 18 Drawing Sheets

FIG. 8

| SEQUENTIAL SEWING ORDER NUMBER | SEWING THREAD INFORMATION | SEWING NEEDLE BAR |
|---|---|---|
| 1 | REDDISH BROWN | |
| 2 | BRIGHT YELLOW | |
| 3 | DARK BROWN | |
| 4 | WHITE | |
| 5 | BEIGE | |
| 6 | BLACK | |

MULTI-NEEDLE TYPE EMBROIDERY SEWING MACHINE AND COMPUTER-READABLE STORAGE MEDIUM INCLUDING A COMPUTER CONTROL PROGRAM FOR THE MULTI-NEEDLE TYPE EMBROIDERY SEWING MACHINE

CROSS-REFERENCE TO RELATED APPLICATION

This application claims priority from JP 2006-175703, filed Jun. 26, 2006, the entire disclosure of which is incorporated herein by reference thereto.

BACKGROUND

The present disclosure relates to technical fields including a multi-needle type embroidery sewing machine equipped with a plurality of needle bars. More specifically, it relates to technical fields including a multi-needle type embroidery sewing machine equipped with a device that changes thread information and a control program for the multi-needle type embroidery sewing machine recorded in a computer-readable storage medium.

In the related art, a multi-needle type embroidery sewing machine has a plurality of needle bars fitted with a sewing needle and a needle bar case which contains the plurality of needle bars in a way that thread spool supplied as a needle thread to each of the sewing needles can be attached to at least as many as the number of the needle bars (sewing needles) or more. Also, a sewing machine control device that controls this multi-needle type embroidery sewing machine may store the needle bars (sewing needles) such that thread information that relates to a color, a thickness, a material, a manufacturer, etc. may be correlated to a thread supplied to these needle bars (sewing needles).

When controlling sewing by a multi-needle type sewing machine, such a sewing machine control device compares thread information contained in sewing data used for sewing, to thread information of threads supplied to needle bars (sewing needles). Then, the sewing machine control device controls the multi-needle type sewing machine so that a needle bar supplied with a thread corresponding to the thread information in this sewing data may be selected as a needle bar which is used in sewing. If the needle bar supplied with the thread corresponding to the thread information in the sewing data is not stored in the sewing machine control device, sewing by the multi-needle type embroidery sewing machine may be suspended.

In such a case, a user will replace a thread spool in order to supply the needle bar (sewing needle) with a thread corresponding to the thread information in the sewing data and resume sewing with the multi-needle type sewing machine. A relationship between each needle bar and a thread supplied to a sewing needle attached to the needle bar must be set by the user. The number of times needed to replace the thread spool should generally be reduced as much as possible to decrease the time during which sewing by the multi-needle type sewing machine is suspended. To achieve this, a variety of approaches have been proposed where a microcomputer in the multi-needle type sewing machine indicates how to replace a thread in the sewing machine.

For example, an embroidery sewing machine disclosed in Japanese Patent Application Laid Open Publication No. Hei 10-140460 stores information (thread colors) of threads attached to the needle bars, thereby displaying a finish of an embroidery pattern before sewing.

SUMMARY

However, the conventionally proposed multi-needle type embroidery sewing machines have had various problems. For example, in a case where a multi-needle type embroidery sewing machine instructs a user to replace two threads attached to a plurality of needle bars (sewing needles), if the user attaches a thread to a wrong needle bar, thread replacement must be performed all over again to attach the two threads to the needle bars specified by the multi-needle type sewing machine.

Further, when thread replacement is required, the multi-needle type embroidery sewing machine may calculate the thread replacement so as to set a thread having thread information that agrees with the thread information contained in the sewing data. Accordingly, the multi-needle type embroidery sewing machine may recognize wrong threads even if their colors have only slightly different RGB values from those indicative of thread colors contained in the thread information and calculates a thread replacement order in which these threads are replaced. Therefore, even if a user determines that a thread color in the sewing data is almost the same as a thread color of a thread set to a needle bar, the multi-needle type embroidery sewing machine may determine that the relevant threads are different from each other and instruct a necessity for thread replacement. Then, the user may wish to continue sewing without replacing the thread by substituting a thread set to a needle bar that is different from the needle bar designated for replacement that has a thread color specified by the multi-needle type embroidery sewing machine. However, since a relationship between the needle bars and a sewing order obtained by the multi-needle type embroidery sewing machine is set in such a manner as not to be changed by the user, there has been a problem in that thread replacement must be carried out.

It is one object of the present disclosure to provide a multi-needle type embroidery sewing machine and a computer-readable storage medium including a computer control program for the multi-needle type embroidery sewing machine that can facilitate work of setting threads for sewing.

According to a first exemplary embodiment, a multi-needle type embroidery sewing machine is provided comprising, a plurality of needle bars, a needle bar thread information storage device that stores needle bar thread information about threads which are set to the needle bars; a needle bar selection device that selects at least suite of two needle bars including a first needle bar and a second needle bar out of the plurality of needle bars, and a control device that stores in the needle bar thread information storage device needle bar thread information that corresponds to the first needle bar selected by the needle bar selection device as needle bar thread information that corresponds to the second needle bar, thereby changing the needle bar thread information that corresponds to the second needle bar.

According to a second exemplary embodiment, a computer-readable storage medium including a computer control program for a multi-needle type embroidery sewing machine is provided where the program comprises instructions for a needle bar thread information storage step of storing needle bar thread information about threads which are set to needle bars, a needle bar selection step of selecting at least one suite of two needle bars including a first needle bar and a second needle bar out of a plurality of the needle bars, and a needle bar thread information alteration step of storing needle bar thread information that corresponds to the first needle bar selected at the needle bar selection step as needle bar thread information that corresponds to the second needle bar, thereby changing the needle bar thread information that corresponds to the second needle bar.

BRIEF DESCRIPTION OF THE DRAWINGS

Exemplary embodiments of the disclosure will be described below in detail with reference to the accompanying drawings in which:

FIG. 8 is a table indicating sewing order and sewing thread information which are extracted from sewing data of Example 1 and stored in a sewing data storage region;

DETAILED DESCRIPTION OF EMBODIMENTS

Exemplary embodiments of the broad principles described herein are described. In one exemplary embodiment, a multi-needle type embroidery sewing machine 11 may be equipped with six needle bars to enable sewing by use of six kinds of threads supplied from a thread spool to sewing needles fitted to these needle bars.

First, one embodiment of the multi-needle type embroidery sewing machine 11 will be described with reference to FIGS. 1 through 3. It should be noted that in FIGS. 1 and 2, a left side of the paper in its front direction is defined to be a "front side of the multi-needle type embroidery sewing machine "1" and a right side of the paper in its depth direction, to be a "rear side of the multi-needle type embroidery sewing machine 11". Further, a left side of the paper in its depth direction is defined to be a "left direction of the multi-needle type embroidery sewing machine" and a right side of the paper in its front direction as viewed from a user, to be a "right direction of the multi-needle type embroidery sewing machine 11".

Figure 1:
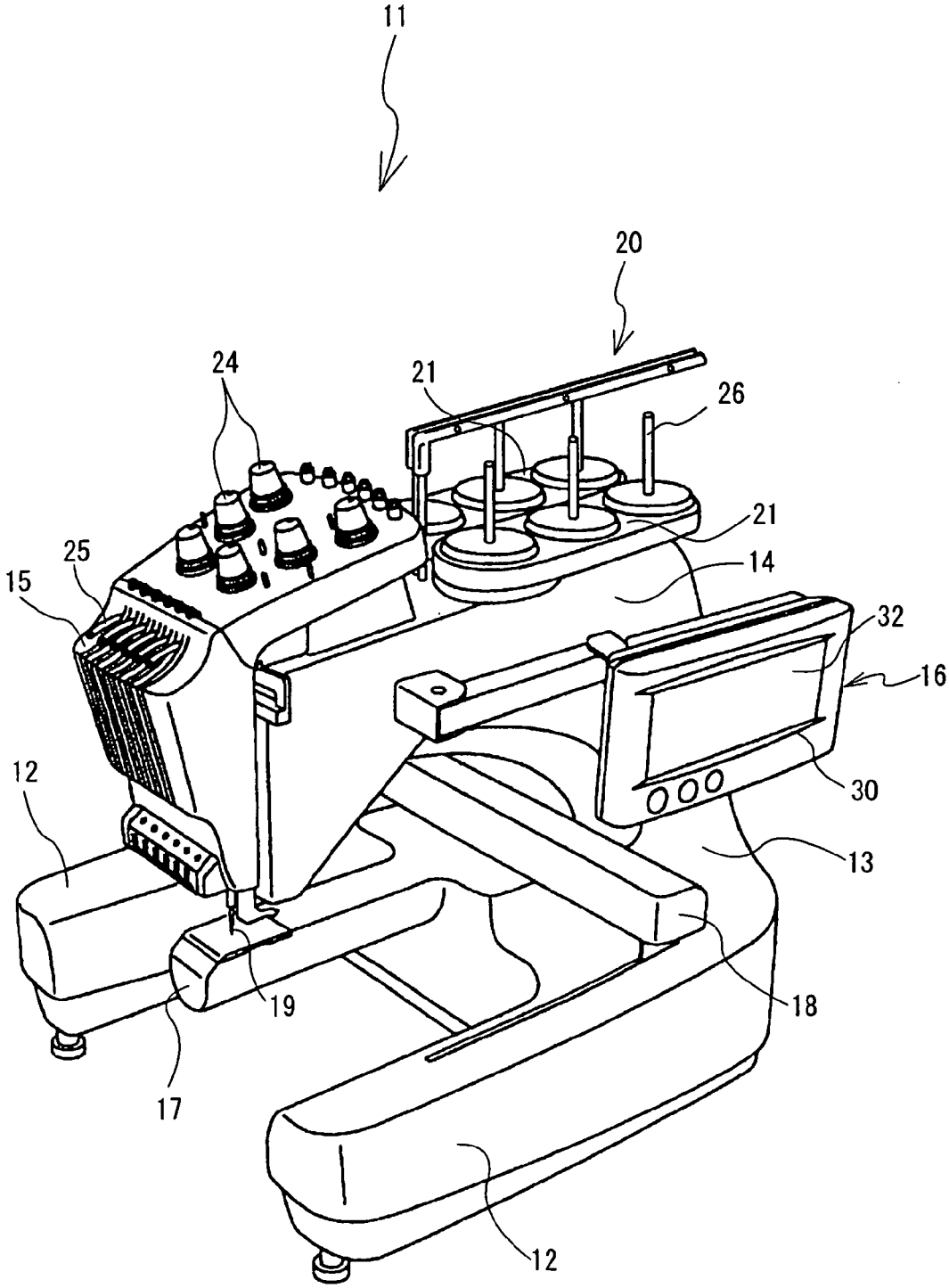
FIG. 1 is a perspective view of a multi-needle type embroidery sewing machine according to the embodiment of the present disclosure.
Figure 2:
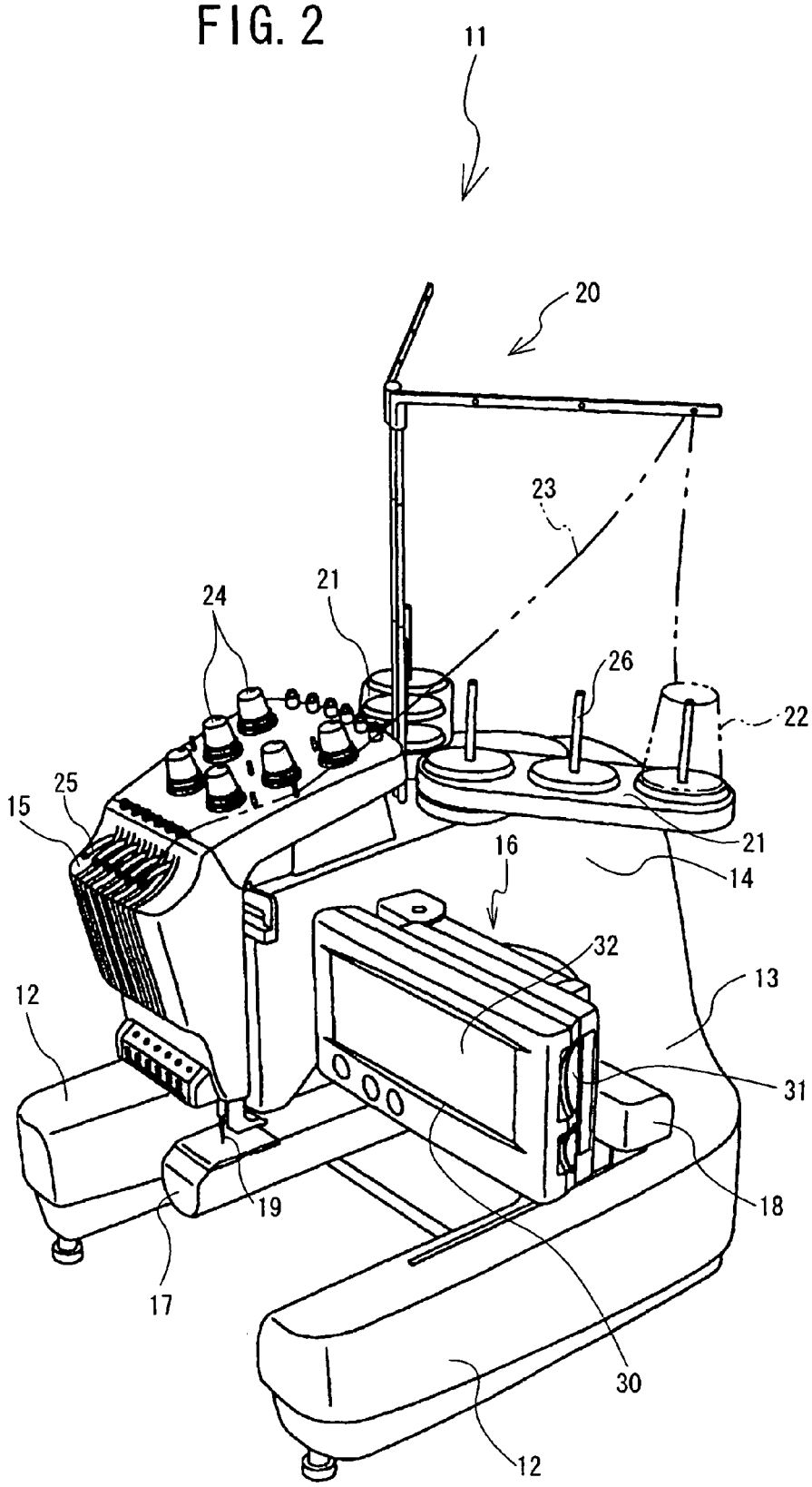
FIG. 2 is a perspective view of the multi-needle type embroidery sewing machine when its thread spool is positioned for use.

As shown in FIGS. 1 and 2, the multi-needle type embroidery sewing machine 11 may be equipped with a support portion 12, a pillar portion 13, an arm portion 14, and a needle bar case 15. The support portion 12 may support the multi-needle type embroidery sewing machine 11. The pillar portion 13 may be erected upward from this support portion 12. The arm portion 14 may extend toward the front side from an upper end of the pillar portion 13. The needle bar case 15 may be attached to an end of the arm portion 14 movable horizontally. At a right-of-center position of the arm portion 14, an operation portion 16 may be provided. The operation portion 16 may be axially supported by the arm portion 14, so that its position can be switched between a housing position shown in FIG. 1 and an operation position shown in FIG. 2. Below the arm portion 14, a cylinder head portion 17 and an embroidery frame movement mechanism 18 may be provided. The cylinder head portion 17 may extend forward from a lower end of the pillar portion 13. The embroidery frame movement mechanism 18 may be provided at the lower end of the pillar portion 13, to have a shape of a rod extended horizontally. The various components of this embodiment of a multi-needle type embroidery sewing machine 11 are described in greater detail below.

First, a thread spool table 21 which may be provided on a back side of an upper surface of the arm portion 14 will be described with reference to FIGS. 1 and 2. As shown in FIGS. 1 and 2, on the back side of the upper surface of the arm portion 14, a pair of right and left thread spool tables 21 may be provided to which a plurality of thread spools 22 may be attached. A thread guide mechanism 20 may be provided in such a manner as to face the thread spool table 21. The thread spool table 21 and the thread guide mechanism 20 may be configured so that their position can be switched between a housing position where they are positioned in parallel with a width direction of the multi-needle type embroidery sewing machine 11 as shown in FIG. 1, and an in-use position where they are in an open position toward the rear side of the multi-needle type embroidery sewing machine 11 as viewed from the top, as shown in FIG. 2. The thread spool table 21 may each be provided with three thread spool pins 26 to which the three thread spools 22 can be fitted and attached respectively. A horizontal pair of thread spool tables 21 can each be fitted with the six thread spools 22, which may correspond to the number of sewing needles 19. A needle thread 23 extending from each thread spool 22 attached to the thread spool table 21 may be supplied via the thread guide mechanism 20, a thread tension device 24, a thread take-up 25, etc. to each of the sewing needles 19. It should be noted that the thread guide mechanism 20 may prevent the needle thread 23 from being tangled, the thread tension device 24 may adjust a thread tension, and the thread take-up 25 may reciprocate vertically to pull up a needle thread.

Figure 3:
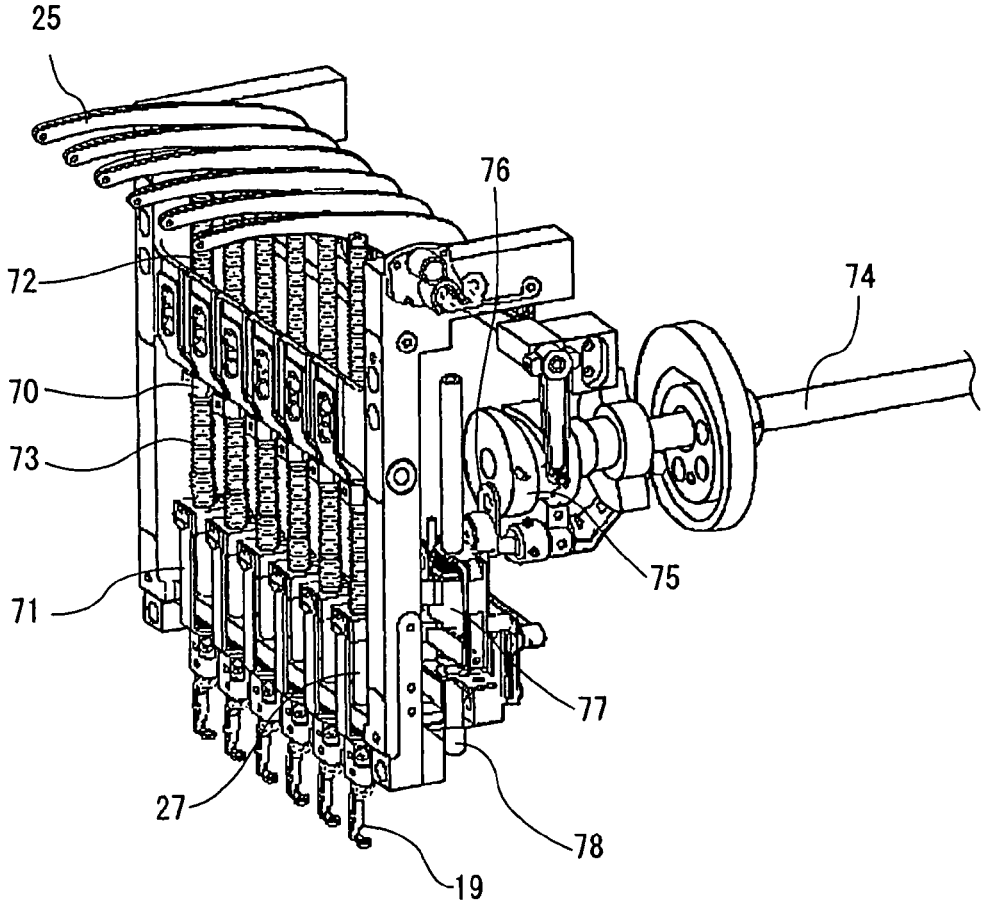
FIG. 3 is a perspective view of an inner constitution of a needle bar case of the multi-needle type embroidery sewing machine.

Next, FIG. 3 illustrates a detailed configuration of the needle bar 15 according to one embodiment, which may be provided on the front side of the arm portion 14. As shown in FIG. 3, six needle bars 27 may be provided in the needle bar case 15, where each needle bar 27 may be provided with each of sewing needles 19 at its lower end. The needle bars 27 may be supported in a vertically slidable manner by a pair of upper and lower holding members 70 (only the upper holding member 70 is shown in FIG. 3) fixed to a frame of the needle bar case 15. Each needle bar 27 may be further fitted at its lower end with a presser foot 71 which can slide vertically. The needle bars 27 may be fitted with a presser spring 72 at its upper part and a presser spring 73 at its lower part, respectively.

Next, the operation portion 16, which may be axially supported by the arm portion 14, will be described with reference to FIGS. 1 and 2. The operation portion 16 may be provided with a liquid crystal display (LCD) 30 that displays thread information, embroidery patterns, etc., a flexible disk drive 31 (hereinafter abbreviated as "FDD") into which a flexible disk (not shown) may be inserted. The LCD 30 displays thread information that may be assigned to the needle bars 27 (see FIGS. 3 and 4), embroidery data of what is to be sewed, needle bar numbers and thread information corresponding to the needle bar 27 that is subject to thread replacement, function names of a variety of functions enabling sewing operations, various messages, etc. The LCD 30 may be fitted with a touch panel 32 (see FIG. 4) on its front surface. An item displayed on the LCD 30, may be selected with a finger or a dedicated pen, which is detected by the touch panel 32, so that various commands can be entered.

Next, FIGS. 1 through 3 illustrate operations to form a stitch in a piece of work cloth attached to an embroidery frame (not shown) which may be supported by the embroidery frame movement mechanism 18 (see FIG. 2). First, when the needle bar case 15 moves right and left, one of the six needle bars 27 may be selected. Then, a main shaft 74 may be rotationally driven by a main shaft motor 54 (see FIG. 4), where the rotational driving force may be transmitted to a coupling member via a thread take-up drive cam 75. This may cause a jump tie 77 on which the coupling member 76 is pivotally supported to be vertically driven as guided by a guide bar 78 which may be disposed horizontally with the needle bars 27. The vertical driving force may be transmitted via a coupling pin (not shown) to the needle bars 27 to vertically drive the needle bars 27 together with the sewing needles 19. In this manner, as the needle bars 27 are driven vertically, and stitches are formed in the work cloth piece.

Figure 4:
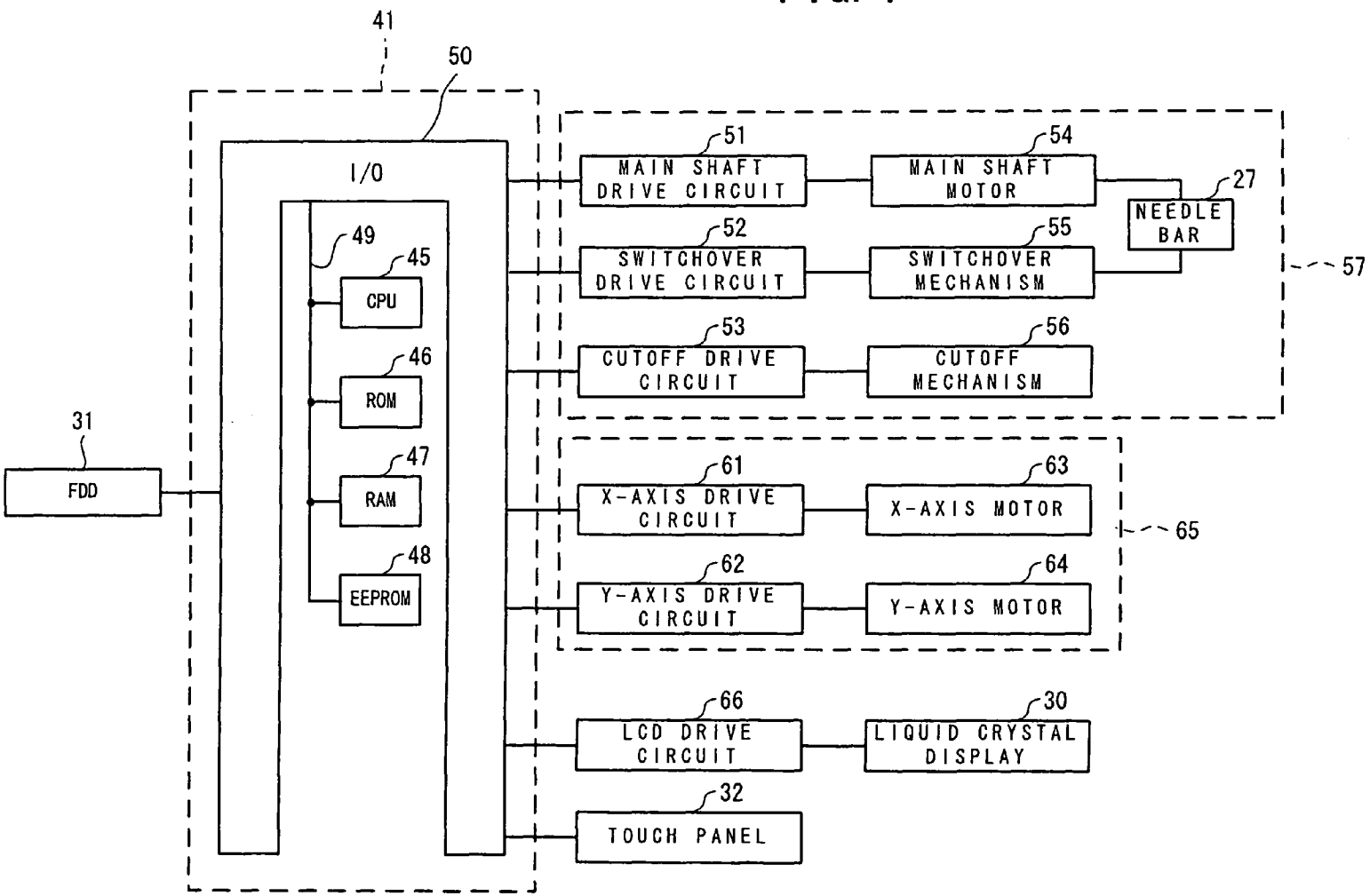
FIG. 4 is a block diagram showing an electrical constitution of the multi-needle type embroidery sewing machine.
Figure 5:
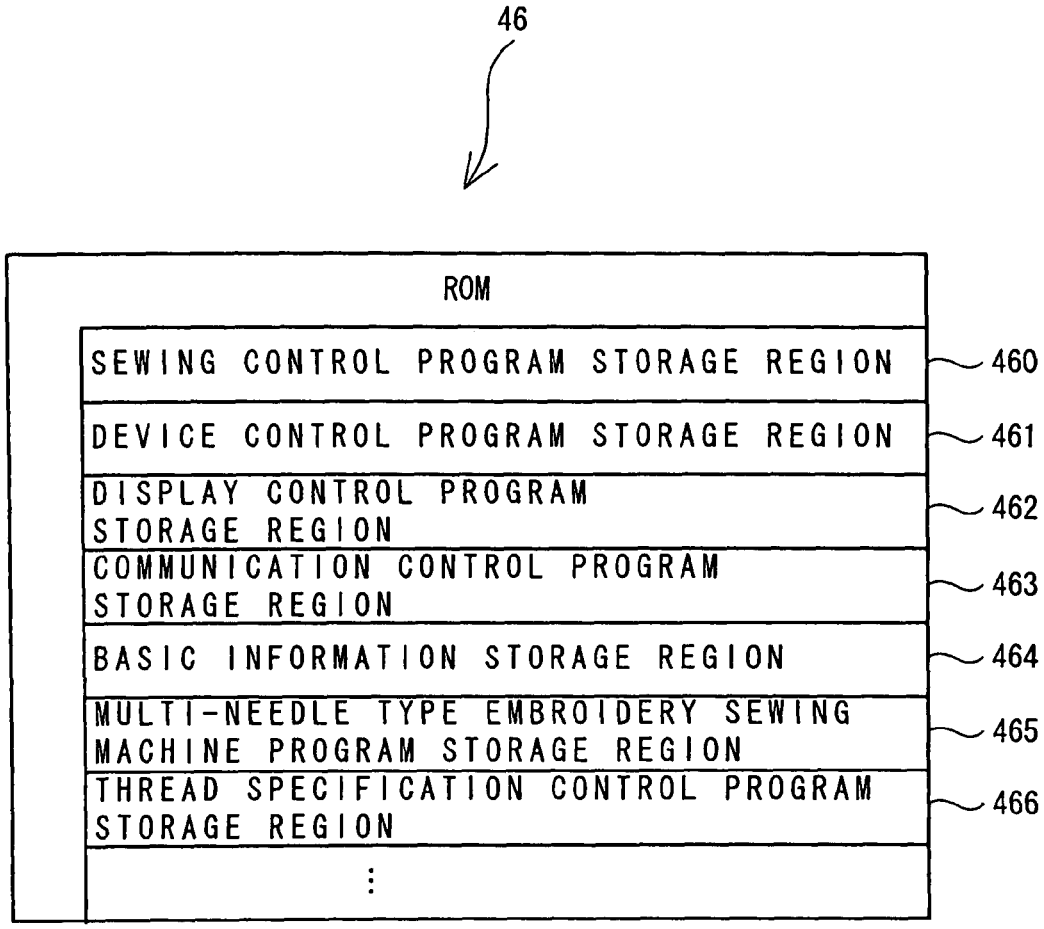
FIG. 5 is a conceptual diagram of storage regions of an ROM.
Figure 6:
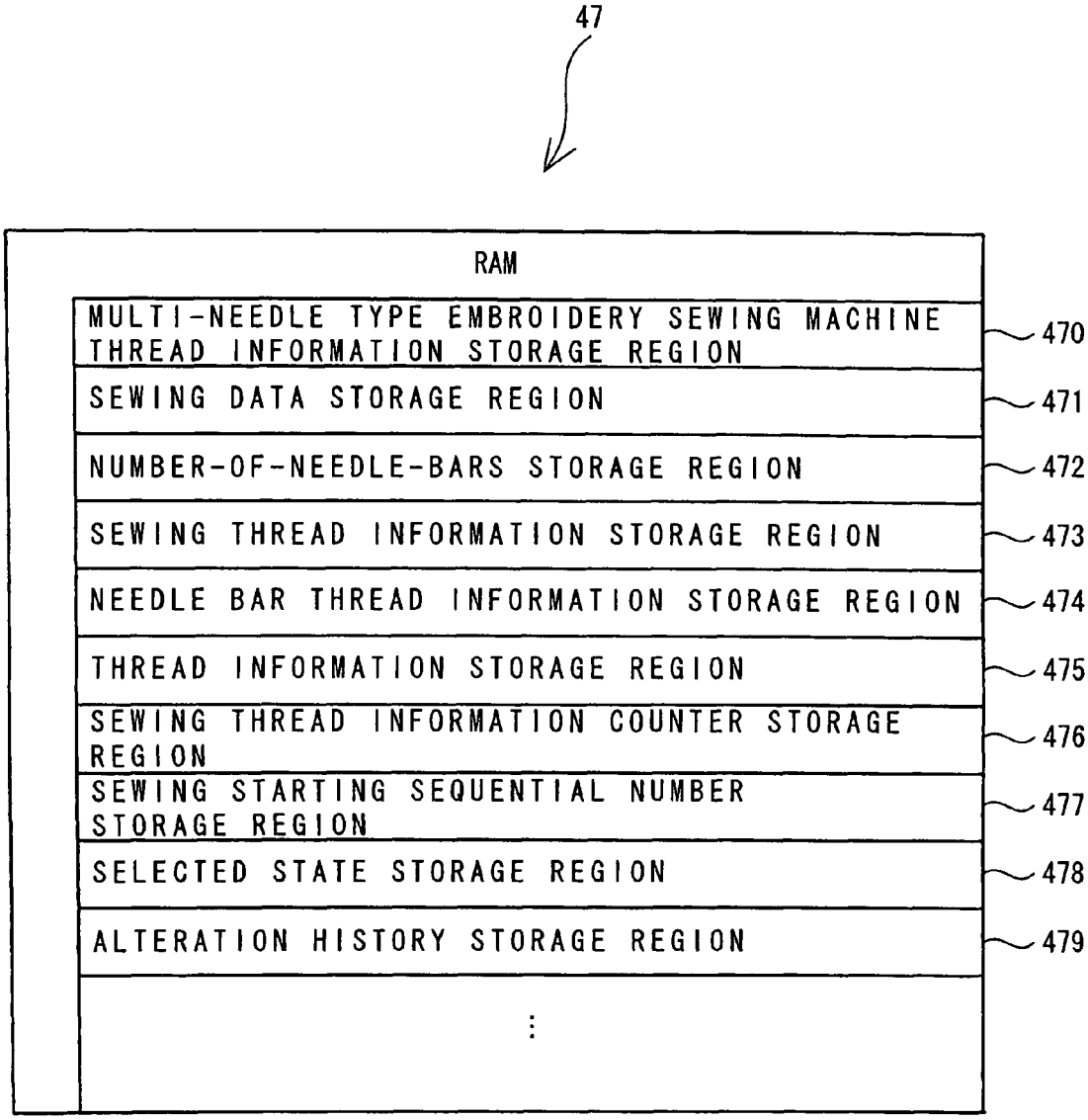
FIG. 6 is a conceptual diagram of storage regions of an RAM.

Next, FIGS. 4 through 6 illustrate an electrical configuration that enables control of the multi-needle type embroidery sewing machine 11. As shown in FIG. 4, the multi-needle type embroidery sewing machine 11 may be represented by a sewing needle drive portion 57, a sewing target drive portion 65, a control unit 41, etc. The sewing needle drive portion 57, the sewing target drive portion 65, and the control unit 41 are described in greater detail below.

The sewing needle drive portion 57 may be equipped with a main shaft motor 54, a main shaft drive circuit 51, a switchover mechanism 55, a switchover drive circuit 52, a cutoff mechanism 56, and a cutoff drive circuit 53. The main shaft motor 54 may reciprocate the needle bars 27 vertically. The main shaft drive circuit 51 may drive the main shaft motor 54 in accordance with a control signal from the control unit 41. The switchover mechanism 55 may switch the needle bars 27. The switchover drive circuit 52 may drive the switchover mechanism 55 in accordance with the control signal from the control unit 41. The cutoff mechanism 56 may cut off threads which are set to the sewing needles 19 (see FIGS. 1 and 2). The cutoff drive circuit 53 may drive the cutoff mechanism 56 in accordance with the control signal from the control unit 41.

The sewing target drive portion 65 may be equipped with an X-axis motor 63 that moves the embroidery frame, not shown, horizontally and an X-axis drive circuit 61 that drives the X-axis motor 63 in accordance with the control signal from the control unit 41. It may also be equipped with a Y-axis motor 64 that moves the embroidery frame, not shown, width-directionally and a Y-axis drive circuit 62 that drives the Y-axis motor 64 in accordance with the control signal from the control unit 41.

The control unit 41 may include a CPU 45, a read only memory (ROM), a random access memory (RAM) 47, an EEPROM 48, an input/output interface (I/O) 50, etc., which may be connected to each other by a bus 49. The input/output interface 50 may be connected with the sewing needle drive portion 57 and the sewing target drive portion 65 as well as the FDD 31, the touch panel 32, and a LCD drive circuit 66 that controls the LCD 30. The CPU 45, the ROM 46, and the RAM 47 of the control unit 41 are described in greater detail below.

The CPU 45 may conduct main control on the multi-needle type embroidery sewing machine 11. The CPU 45 may perform various calculations and processing pieces related to sewing operations in accordance with a sewing control program stored in a sewing control program storage region 460 (see FIG. 5) in the ROM 46. The CPU 45 may also perform various calculations and processing pieces in accordance with a multi-needle type embroidery sewing machine program in accordance with the present disclosure that may be stored in a multi-needle type embroidery sewing machine program storage region 465 (see FIG. 5). It should be noted that the multi-needle type embroidery program may optionally be stored in an external storage device such as a flexible disk, in which case the disk reads this program into the RAM 47 and executes the program.

The ROM 46 may have a storage region to store a program for operating the multi-needle type embroidery sewing machine 11 based on sewing data. The ROM 46 will be described in greater detail with reference to FIG. 5. As shown in FIG. 5, the storage region of the ROM 46 may include the sewing control program storage region 460, a device control program storage region 461, a display control program storage region 462, a communication control program storage region 463, a basic information storage region 464, the multi-needle type embroidery sewing machine program storage region 465, a thread specification control program storage region 466, etc. The sewing control program storage region 460 may store the sewing control program that controls driving of the devices that may be needed for sewing. The device control program storage region 461 may store a program that controls the relevant devices that are not generally used for sewing. The display control program storage region 462 may store a program that controls the LCD 30. The communication control program storage region 463 may store a program that transmits and receives commands and data between the multi-needle type embroidery sewing machine 11 and an external device. The basic information storage region 464 may store type information indicating, for example, a type of the multi-needle type embroidery sewing machine 11, size information of a size of a sewing area, the number of the needle bars, etc. The multi-needle type embroidery sewing machine program storage region 465 may store the multi-needle type embroidery sewing machine program. The thread specification control storage region 466 may store a thread specification control program that is used by a user to correlate a thread information table that may list thread information about a plurality of kinds of threads used in sewing, thread information of the needle thread 23 (see FIG. 2) supplied from the thread spool 22, and the needle bar 27. The thread information table stored in the thread specification control program storage region 466 may include thread information about several thousands of kinds of threads. The thread information of each of the threads may include, for example, a thread information number, a manufacturer's name, a thread color, a name, a thickness, a material, etc. It should be noted that the thread information number may be a unique number which is set for each piece of thread information, so that the corresponding thread information can be identified uniquely.

The RAM 47 is a random access memory which may include storage regions to store data to change needle bar thread information and data to determine a sewing needle bar. The RAM 47 will be described in greater detail with reference to FIG. 6. As shown in FIG. 6, the RAM 47 may include a multi-needle type embroidery sewing machine thread information storage region 470, a sewing data storage region 471, a number-of-needle-bars storage region 472, a sewing thread information storage region 473, a needle bar thread information storage region 474, a thread information storage region 475, a sewing thread information counter storage region 476, a sewing starting sequential number storage region 477, a selected state storage region 478, an alteration history storage region 479, etc. The multi-needle type embroidery sewing machine thread information storage region 470 may store thread information about a thread attached to the multi-needle type embroidery sewing machine 11. The sewing data storage region 471 may store sewing data of a plurality of embroidery patterns. The number-of-needle bars storage region 472 may store the number of needle bars N. The sewing thread information storage region 473 may store sewing thread information. The needle bar thread information storage region 474 may store needle bar thread information. The thread information storage region 475 may preliminarily store six (for embodiments having six needle bars) pieces of thread information which are stored in the needle bar thread information storage region 474. The sewing thread information counter storage region 476 may store a counter that reads sewing thread information in a sewing order. The sewing starting sequential number storage region 477 may store a staring sewing order which is employed to determine a sewing needle bar that corresponds to a sewing order. The selected state storage region 478 may store a selection flag and a needle bar number, which may be correlated with each other, and which indicate whether or not a needle bar indicated on the LCD 30 is selected. The alteration history storage region 479 may store numbers of the needle bars whose needle bar thread information has been changed.

Figure 9:
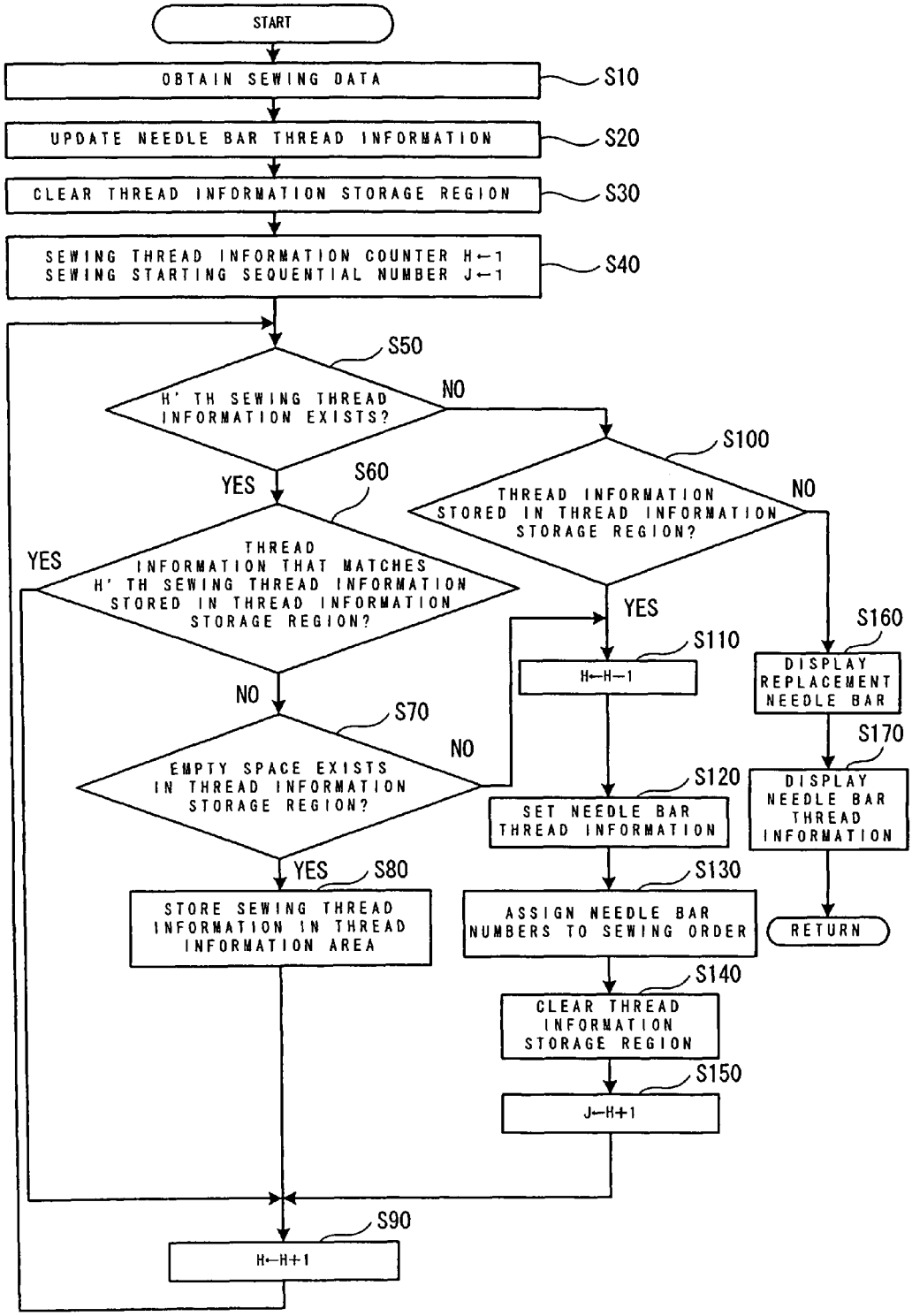
FIG. 9 is a flowchart showing a flow of sewing needle bar determination processing.
Figure 10:
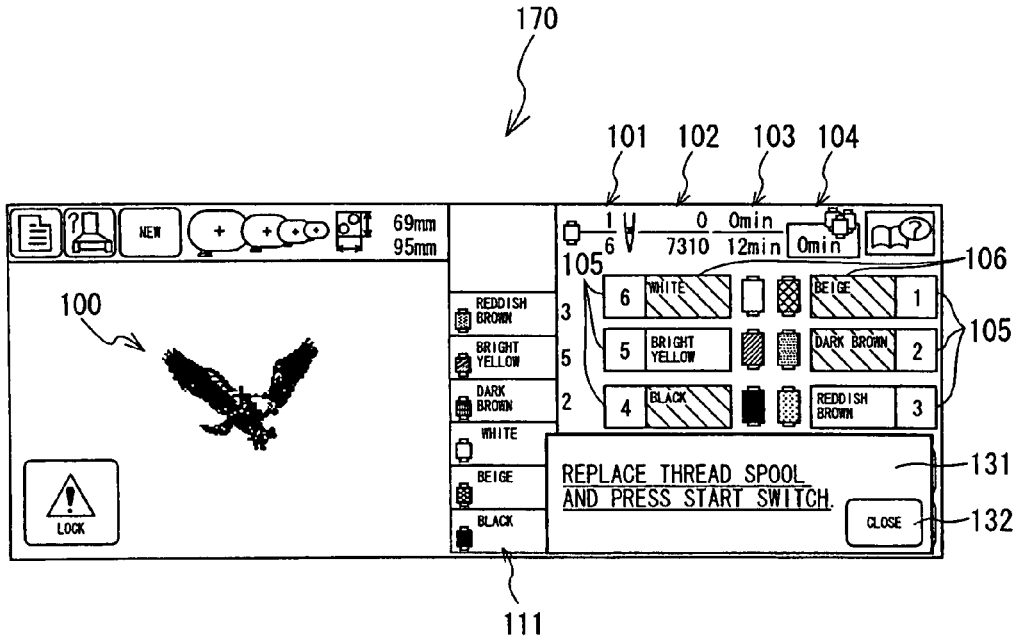
FIG. 10 is an illustration of a screen on which needle bars to be replaced are displayed.
Figure 11:
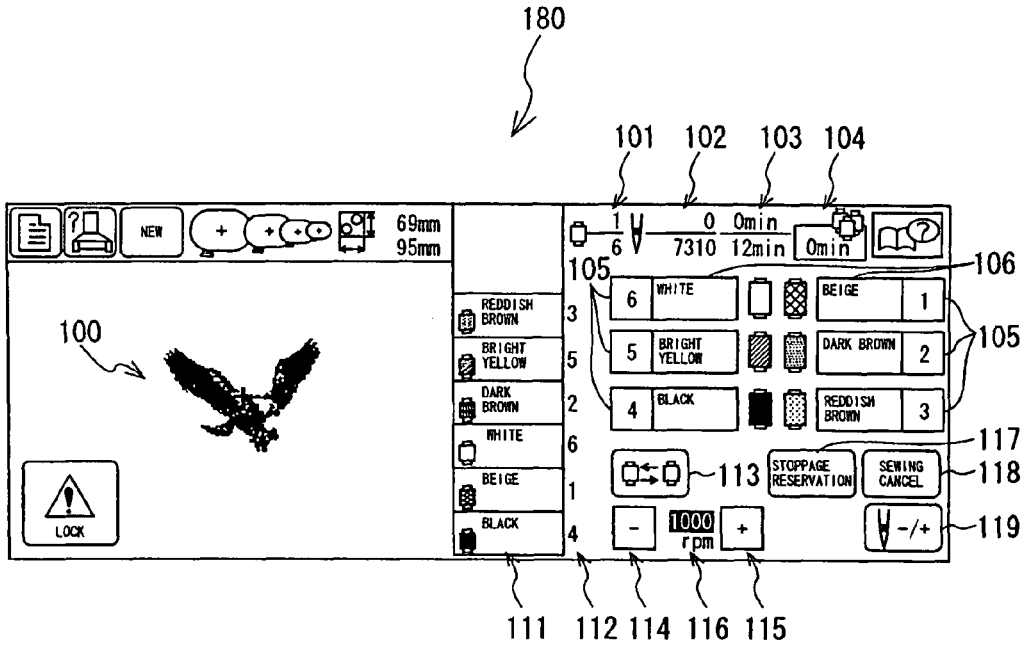
FIG. 11 is an illustration of a screen on which sewing needle bars and sewing thread information are displayed.
Figure 12:
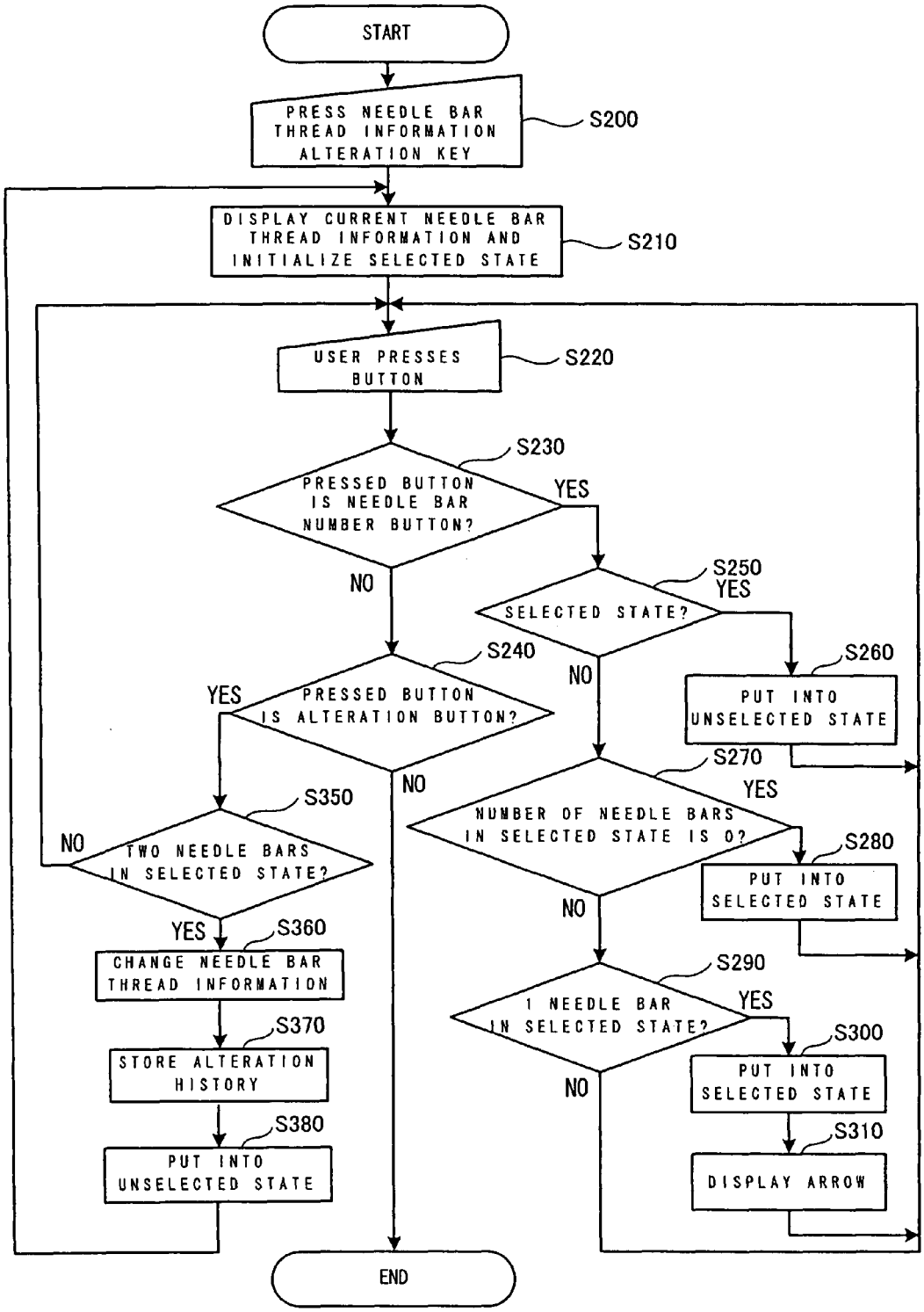
FIG. 12 is a flowchart showing a flow of needle bar thread information alteration processing.
Figure 13:
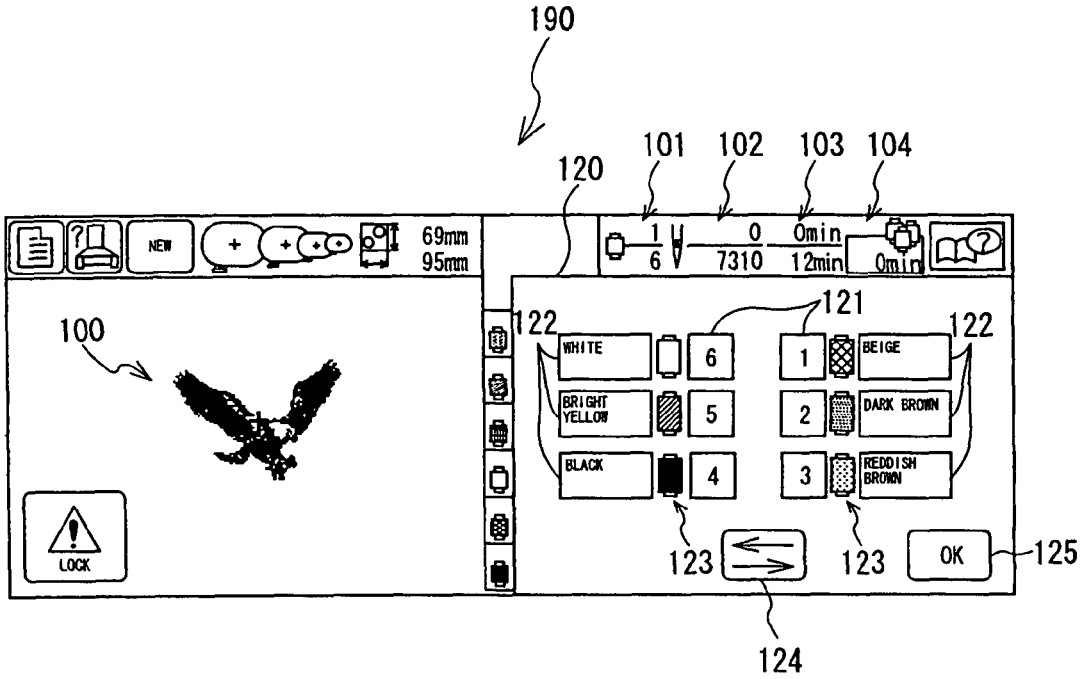
FIG. 13 is an illustration of a needle bar thread information alteration screen displayed on a front surface of the screen.
Figure 14:
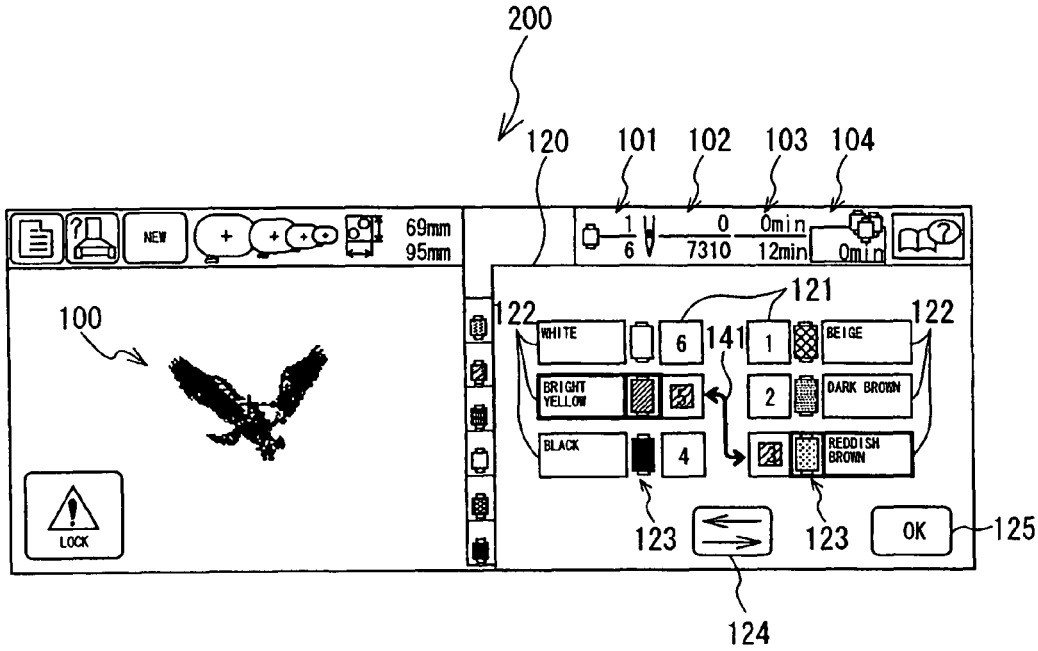
FIG. 14 is an illustration of the needle bar thread information alteration screen on which arrows are displayed.
Figure 15:
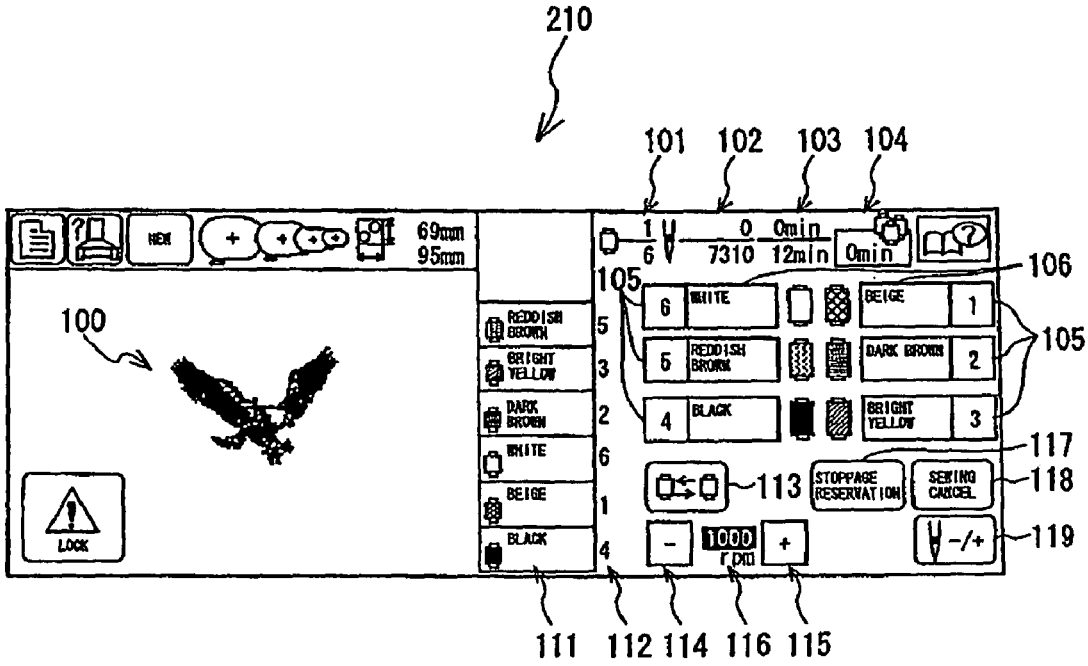
FIG. 15 is an illustration of a screen which displays sewing needle bars determined again after the needle bar thread information alternation processing is ended.

Next, FIGS. 7 through 15 illustrate a processing procedure that may be used to alter needle bar information when determining a sewing needle bar for an embroidery pattern 100, shown in FIG. 10 as Example 1, in a multi-needle type embroidery sewing machine 11 having the above-described configuration. It should be noted that the program that performs processing (not shown) to determine a sewing needle bar again, i.e., after sewing needle bar determination processing shown in FIG. 9, and needle bar thread information alteration processing shown in FIG. 12 are performed, may be stored in the multi-needle type embroidery sewing machine program storage region 465 (see FIG. 5) in the ROM 46. Further, this program may be executed by the CPU 45 shown in FIG. 4.

FIG. 8 illustrates a portion of the embroidery data pieces used to sew the embroidery pattern 100; specifically a sewing order and sewing thread information which may be stored in the sewing thread information storage region 473 are described with reference to FIG. 8. As shown in FIG. 8, sewing data of the embroidery pattern 100 may include six pieces of thread information. In this embodiment, the embroidery pattern 100 is sewed using threads having six thread colors of reddish brown, bright yellow, dark brown, white, beige, and black in this sewing order. It should be noted that thread information contained in the sewing data stored in the sewing data storage region 471 may include a thread information number, a manufacturer's name, a name, a thread color, a thickness, and a material and, accordingly, can be identified uniquely with a unique thread information number. However, in Example 1, to simplify description, the thread information is supposed to include only information about the thread colors.

Figure 7:
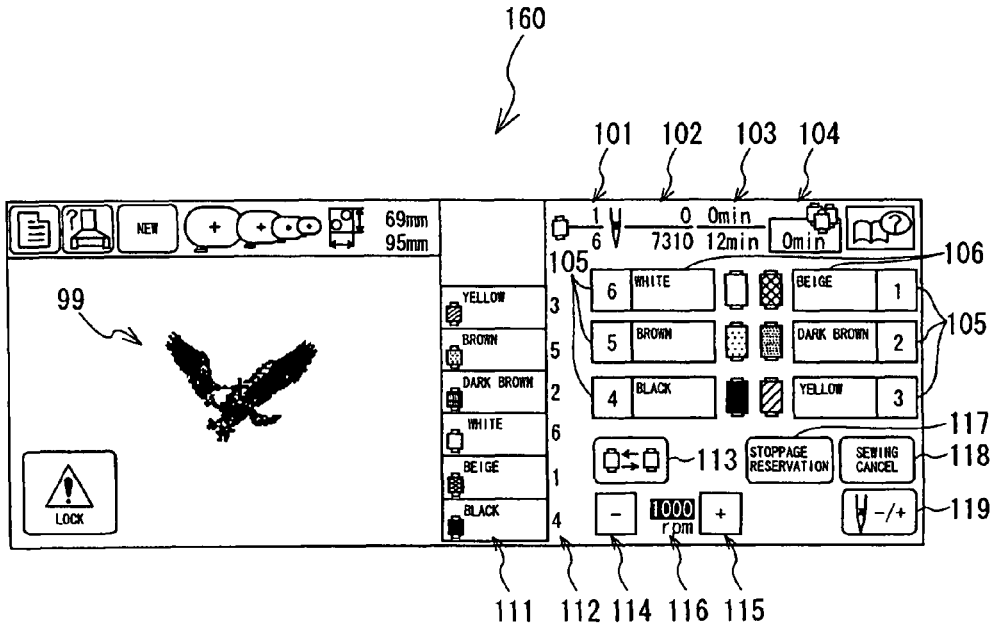
FIG. 7 is an explanatory illustration of a screen that displays thread information of threads attached to respective needle bars of the multi-needle type embroidery sewing machine.

Next, contents displayed on a screen 160 are described with reference to FIG. 7. The screen 160 may appear on the LCD 30. This screen may display an embroidery pattern 99 that is selected before the embroidery pattern 100 according to Example 1 is selected and various information pieces required to sew the embroidery pattern 99. The following will describe in greater detail various kinds of information displayed on the screen 160. First, needle bar keys 105 that indicate needle bar numbers are buttons which may be used to move the needle bar 27 (see FIGS. 3 and 4) that corresponds to the needle bar numbers to a sewing position. Thread indicators 106 displayed adjacent to the needle bar keys 105 indicate thread information of a thread which is attached or which will be attached to the needle bar. As described above, in the present embodiment, thread information includes thread colors only, so that a thread color that corresponds to each needle bar number is indicated at the thread indicators 106. Further, a sewing needle bar indicator 112 may indicate the needle bar numbers of the sewing needle bars that correspond to the sewing thread information indicated at a sewing order indicator 111 displayed on the left side of the sewing needle bar indicator 112. On the screen 160, in this Example, the sewing order indicator 111 indicates "yellow, brown, dark brown, white, beige, and black" in this sewing order as sewing thread information used to sew the embroidery pattern 99. Further, the sewing needle bar indicator 112 may indicate a needle bar number of a sewing needle bar that corresponds to each piece of a sewing thread information and displays a sewing order in this embodiment of "3, 5, 2, 6, 1, and 4".

A sequential sewing number 101 may be displayed at an upper part of the screen 160 and may indicate a total number of color replacements of an embroidery pattern at its lower stage and an order of thread information of a thread currently sewed at its upper stage. That is, the sequential sewing number 101 on the screen 160 shown in FIG. 7 indicates six as the total number of color replacements of the embroidery pattern 99 and one as the order of the information of the currently sewed thread. Further, on the right side of the sewing order numeral 101, a number-of-stitches 102 is displayed. The number-of-stitches 102 indicates a total number of stitches used to sew an embroidery pattern at its lower stage and the number of stitches which are finished in sewing at its upper stage. That is, the number-of-stitches 102 on the screen 160 shown in FIG. 7 indicates that the embroidery pattern 99 in this Example requires 7310 stitches. Further, since the pattern is yet to be sewed, it indicates that the number of stitches which are finished is zero. A sewing time 103 may indicate a total required time which is necessary to sew the embroidery pattern 99 not taking into account a time for thread replacement at its lower stage and a time when sewing is finished at its upper stage. That is, the sewing time 103 on the screen 160 shown in FIG. 7 indicates that the total required time for the embroidery pattern 99 in this Example is 12 minutes. A thread replacement time 104 may indicate an amount of time that elapses during thread replacement when sewing an embroidery pattern having at least seven colors with, for example, a multi-needle type embroidery sewing machine 11 that can be fitted with only six colors of thread spools, as shown in the embodiment illustrated in FIGS. 1 and 2. Since the embroidery pattern 99 in Example 1 can be sewed with six colors of threads, by performing thread replacement before sewing, no threads need to be replaced during the sewing, so that the thread replacement time 104 on the screen 160 shown in FIG. 7 indicates zero (0) minute.

A needle bar thread information alteration key 113 is a button for displaying a needle bar thread information alteration screen 120 (see FIG. 13) used to perform the needle thread information alteration processing. A stoppage reservation key 117 is a button for instructing the multi-needle type embroidery sewing machine 11 to stop during sewing a pattern immediately before sewing it with a thread specified by the next sewing thread information. A sewing cancel key 118 is a button for instructing the multi-needle type embroidery sewing machine to cancel sewing and for displaying a sewing setting screen. A stitch reversion/advancement key 119 is a button for instructing the multi-needle type embroidery sewing machine to reverse or advance a stitch if a thread is cut off or has gone off during sewing.

Next, thread information of a thread attached to each of the needle bars 27 (see FIGS. 3 and 4) in the multi-needle type embroidery sewing machine 11 will be described in greater detail with reference to FIG. 7. As indicated by the needle bar keys 105 and the thread indicators 106 on the screen 160 displayed on the LCD 30 shown in FIG. 7, in the multi-needle type embroidery sewing machine 11 in this Example, a beige thread is set to the needle bar 27 having the needle bar number "1" (hereinafter referred to as "needle bar "X" simply, where X indicates a needle bar number), a dark brown thread is set to the needle bar "2", a yellow thread is set to the needle bar "3", a black thread is set to the needle bar "4", a brown thread is set to the needle bar "5", and a white thread is set to the needle bar "6".

Next, as Example 1, the processing features will be described which perform the sewing needle bar determination processing that determines a sewing needle bar and a replacement needle bar when sewing the above-described embroidery pattern 100, and the needle bar thread information alteration processing. Additionally, processing is described below for determining a sewing needle bar again based on needle bar thread information changed by this needle bar thread information alteration processing.

Out of the processing steps in Example 1 needed for the embroidery pattern 100 to be sewn, the sewing needle bar determination processing that determines a sewing needle bar in accordance with each sewing order is shown in FIG. 8 and will also be described with reference to the flowchart shown in FIG. 9. In the sewing needle bar determination processing in accordance with one embodiment, first the process may perform sewing in accordance with sewing data of sequential sewing numbers until thread replacement is required and, immediately before sewing in accordance with the sewing data that requires thread replacement, may determine sewing needle bars in anticipation of replacing threads altogether. Therefore, when the user selects the embroidery pattern 100 from among various embroidery patterns displayed on the LCD 30, the sewing needle bar determination processing shown in FIG. 9 may begin.

As shown in FIG. 9, in step S10 in the sewing needle bar determination processing, first the process obtains sewing data required to sew the embroidery pattern 100 stored in the sewing data storage region 471 in the RAM 47. Specifically, as shown in FIG. 8, a sewing order and sewing thread information are stored in the sewing thread information storage region 473. This sewing data may be directly entered by the user from the LCD 30 into the multi-needle type embroidery sewing machine 11 and stored in the sewing data storage region 471. Alternatively, the sewing data may be fetched from any other device (e.g., the FDD 31 (see FIG. 4)) and may be stored in the sewing data storage region 471.

Subsequently, in step S20 the process shown in FIG. 9 refers to the multi-needle type embroidery sewing machine thread information storage region 470, to store thread information of a thread set in the multi-needle type embroidery sewing machine 11 in the needle bar thread information storage region 474 as needle bar thread information. This processing makes it possible to determine a sewing needle bar based on the currently set needle bar thread information. The thread information of the thread set to each of the needle bars 27 in the multi-needle type embroidery sewing machine 11 may be entered by the user and stored in the multi-needle type embroidery sewing machine thread information storage region 470. Alternatively, the thread information of the thread set to each thread spool pin 26 (see FIGS. 1 and 2) may be detected by a thread information sensor which is equipped into the multi-needle type embroidery sewing machine 11 so that information from this thread information sensor may be stored in the multi-needle type embroidery sewing machine thread information storage region 470.

It should be noted that the needle bar thread information storage region 474 may store not only thread information of a thread currently set to the multi-needle type embroidery sewing machine 11 as needle bar thread information but also may store thread information of a thread expected to be set in sewing to the multi-needle type embroidery sewing machine 11 as needle bar thread information. Therefore, the needle bar thread information storage region 474 may be configured so as to be capable of storing thread information whose number is larger than the number of the needle bars as needle bar thread information, in such a manner that it may be possible to distinguish between the thread information of the currently set thread and the thread information of a thread which is set after thread replacement. The needle bar thread information storage region 474 in accordance with the present embodiment may store a thread replacement flag that indicates the number of times of thread replacement and a needle bar which needs thread replacement in a condition where they are correlated with needle bar thread information, in order to store the thread information of the currently set thread and that of the thread which is set after thread replacement in such a manner that they can be distinguished from each other. In the case of storing the thread information of the currently set thread as needle bar thread information, the number of times of thread replacement may be stored as "0". Further, in the case of storing the thread information of a thread which is set after thread replacement is performed once as needle bar thread information, the number of times of thread replacement may be stored as "1". Also, for a needle bar that needs thread replacement in the thread replacement processing, the thread replacement flag may be stored as an "ON" state. On the other hand, for a needle bar that does not need thread replacement, the thread replacement flag may be stored as an "OFF" state. Therefore, at step S20 of storing thread information of a thread set to a needle bar as needle bar thread information, the needle bar thread information may be stored in the needle bar thread information storage region 474 as having the number of times of thread replacement being "0" and the thread replacement flag may be set as the "OFF" state.

Subsequently, in step S30 the process may clear thread information stored in the thread information storage region 475 provided in the RAM 47. This processing makes it possible to clear thread information which was used to determine a sewing needle bar previously and is currently stored in the thread information storage region 475. It should be noted that the RAM 47 generally may store thread information pieces as many as the number of the needle bars 27 (see FIGS. 3 and 4) stored in the number-of-needle-bars storage region 472, that is, in this Example six.

Subsequently, the process may read sewing thread information used to sew the embroidery pattern 100, in accordance with the sewing order. Accordingly, 1 may be set to a sewing thread information counter H to thereby initialize the sewing thread information counter H. Also, 1 may be set to a sewing starting sequential number J that may be used when assigning a needle bar number of a sewing needle bar into the sewing order, to thereby initialize the sewing starting sequential number J. In step S40, initialized sewing thread information counter H may be stored in the sewing thread information counter storage region 476 and the sewing starting sequential number J may be stored in the starting sewing number storage region 477.

Subsequently, at S50 the process may determine whether or not there is sewing thread information that has a sequential number of H in the sewing order. To do so, the sewing thread information storage region 473 may be referred to. In this Example, since the sewing thread information storage region 473 stores "reddish brown" coming first in the sewing order, the process determines that there is sewing thread information that has the first sequential number (H=1) in the sewing order (YES at S50).

Subsequently, in step S60 the process may refer to the sewing thread information storage region 473 and the thread information storage region 475, to determine whether or not thread information whose first sewing thread information matches "reddish brown" is stored in the thread information storage region 475. After sewing thread information pieces are stored in the thread information storage region 475 for as many as the number of the needle bars 27 (see FIGS. 3 and 4), this processing may be performed to compare the thread information stored in the thread information storage region 475 to needle bar thread information. By performing such processing, it is possible to carry out sewing in accordance with sewing data of sequential sewing numbers until thread replacement is required and, immediately before sewing in accordance with the sewing data that requires thread replacement, a sewing needle bar may be determined in anticipation of replacing threads altogether.

At the above-described S30, the thread information stored in the thread information storage region 475 has been cleared, so that "reddish brown" which comes first in order of sewing the embroidery pattern 100 is not stored in the thread information storage region 475 (NO at S60). Subsequently, at step S70 the process refers to the thread information storage region 475 to determine whether or not the thread information storage region 475 has an empty space. This processing may be performed to determine whether or not the thread information storage region 475 has an empty storage space to store sewing thread information. As described above, in this Example, the thread information storage region 475 can store six thread information pieces and currently stores no thread information, so that the process determines that it has an empty space (YES at S70). Subsequently, at step S80 the process may store this sewing thread information of "reddish brown" in the thread information storage region 475 together with the "OFF" state of the thread replacement flag to determine whether or not the relevant needle bar needs thread replacement.

Subsequently, in step S90 the process may increment the sewing thread information counter H by one (1) and stores it in the sewing thread information counter storage region 476 in order to read the sewing thread information which comes next in sewing order. Subsequently, the process returns to S50 to repeat the above processing.

In the same manner as with the case where the sewing thread information counter H is set as 1 as described above, the process may repeat the processing of S80 to sequentially store, in the thread information storage region 475, the sewing thread information of "bright yellow" in the second, that of "dark brown" in the third, that of "white" in the fourth, that of "beige" in the fifth, and that of "black" in the sixth as in the sewing order, as shown in FIG. 8. After the sixth (H=6) sewing thread information of "black" is stored in the thread information storage region 475 through the processing of S80, the process may increment the sewing thread information counter HY by one (1) at the following step of S90 and stores 7 (H=7) in the sewing thread information counter storage region 476. As shown in FIG. 8, the embroidery pattern 100 in Example 1 is sewn in accordance with the six sewing thread information pieces, so that there is not a seventh sewing thread information piece in the sewing order. Therefore, the process may return to S50 to determine that there is no sewing thread information piece that comes seventh in the sewing order (NO at S50). Through this processing, the process may determine that all the sewing thread information pieces are stored in the thread information storage region 475.

Subsequently, at step S100 the process may compare the thread information stored in the thread information storage region 475 and the needle bar thread information to each other and may determine whether or not thread information is stored in the thread information storage region 475 in order to determine whether or not it is necessary to change the needle bar thread information. Since the six thread information pieces of "reddish brown, bright yellow, dark brown, white, beige, and black" are stored by the processing of S80 in this Example, the process may determine that thread information is stored in the thread information storage region 475 (YES at S100).

At the next step of S100, the process may decrement the sewing thread information counter H by one (1) and stores it in the sewing thread information counter storage region 476. Subsequently, at step S120 the process may refer to the thread information stored in the thread information storage region 475 and the needle bar thread information stored in the needle bar thread information storage region 474, and may set needle bar thread information. In this example, to set the needle bar thread information, first the process may determine whether or not the thread information pieces of "reddish brown, bright yellow, dark brown, white, beige, and black" stored in the thread information storage region 475 are stored in the needle bar thread information storage region 474 as needle bar thread information. If thread information that matches the thread information stored in the thread information storage region 475 is stored as needle bar thread information, the process may store a needle bar number that corresponds to that needle bar thread information stored in the needle bar thread information storage region 474 as a needle bar number that corresponds to the thread information in the thread information storage region 475. In Example 1, "2", "6", "1", and "4" are stored in the thread information storage region 475 as the needle bar numbers that correspond to the thread information pieces of "dark brown", "white", "beige", and "black"

respectively out of the thread information pieces of "reddish brown, bright yellow, dark brown, white, beige, and black" stored in the thread information storage region 475. On the other hand, "0" is stored in the thread information storage region 475 as a needle bar numbers that correspond to the thread information pieces of "reddish brown" and "bright yellow" not stored in the needle bar thread information storage region 474.

Next, in this Example, the needle bar numbers "3" and "5" not stored in the thread information storage region 475 out of the needle bar numbers of "1" through "6" are assigned in an ascending order of the needle bar number to the thread information pieces of "reddish brown" and "bright yellow" that have the corresponding needle bar number of "0" out of the thread information pieces stored in the thread information storage region 475. That is, the smaller needle bar number of "3" may be assigned as a needle bar number that corresponds to the thread information of "reddish brown" and "5" may be assigned as a needle bar number that corresponds to the thread information of "bright yellow" and these numbers may be stored in the thread information storage region 475 sequentially. Moreover, since thread replacement is necessary to perform sewing with threads having these thread information pieces of "reddish brown" and "bright yellow", the thread replacement flags that correspond to these thread information pieces respectively may be stored in the thread information storage region 475 as the "ON" state.

Subsequently, in S120 the needle bar numbers and the corresponding thread information stored in the thread information storage region 475 are stored in the needle bar thread information storage region 474 together with the number of times of thread replacement being one (1) and the thread replacement flags, thereby setting needle bar thread information. The thread replacement flags that correspond to the needle bars "3" and "5" are stored as the "ON" state, and those that correspond to the other needle bars are stored as the "OFF" state in the needle bar thread information storage region 474. It should be noted that if the thread information pieces of "reddish brown, bright yellow, dark brown, white, beige, and black" stored in the thread information storage region 475 are all stored in the needle bar thread information storage region 474 as needle bar thread information at S120, the process may determine that sewing is possible without replacing the threads. In this case, therefore, no needle bar thread information is set newly.

At the following step S130, a needle bar number with respect to the sewing order may be assigned to the sewing needle bar and may be stored in the sewing thread information storage region 473. In this processing, first the process may refer to the sewing thread information storage region 473 and the needle bar thread information storage region 474. Then, the process may determine what number needle bar the needle bar thread information as which needle bar thread information that matches sewing thread information corresponding to the sequential sewing numbers is assigned to sequential sewing numbers of 1 (J=1) through 6 (H=6) corresponds to. Then, needle bar numbers that correspond to the needle bar thread conditions that matches the sewing thread information may be stored in the sewing thread information storage region 473 as the needle bar numbers of a sewing needle bar that corresponds to the sequential sewing numbers. In Example 1, the sequential number "3, 5, 2, 6, 1, and 4" is assigned respectively to the sewing needle bars in an ascending sewing order and stored in the sewing thread information storage region 473.

Subsequently, in step S140 the process may clear the thread information storage region 475 as in the case of S10 and may set H incremented by one (1), that is, seven (7), to the sewing starting sequential number J. Then, at step S150 the process stores it in the sewing starting sequential number storage region 477 and in step S90 and may store the sewing thread information counter H incremented by one (1), that is, seven (7), in the sewing thread information counter storage region 476. Subsequently, the process returns to S50 to determine again that there is no sewing thread information that comes seventh in the sewing order (NO at S50). Subsequently, at step S100 since the thread information storage region 475 was cleared at S140, the process determines that no thread information is stored in the thread information storage region 475 (NO at S100). Subsequently, at step S160 the process may refer to the needle bar thread information storage region 474, to display the needle bars "3" and "5" which need thread replacement before staring sewing and whose thread replacement flag is stored as the "ON" state as a replacement needle bar on a screen 170 shown in FIG. 10. The screen 170 may display the backgrounds of the thread indicators 106 of the replacement needle bars "3" and "5" that need thread replacement in white as well as the thread information pieces of "reddish brown" and "bright yellow" of threads to be attached to the needle bars that correspond to the needle bars "3" and "5" after thread replacement. On the other hand, the backgrounds of the thread indicators 106 of needle bars "1", "2", "4", and "6" of the needle bars that do not need thread replacement may be hatched in the display. Accordingly, the screen 170 makes it possible to easily understand which needle bar is a replacement needle bar that needs thread replacement. Further, by referring to the screen 170, the user can determine whether or not a thread of any other needle bar can be substituted in order to reduce thread replacements as much as possible. Further, such a case will be described below to display a replacement needle bar for a pattern that has at least seven sequential numbers in a sewing order. A replacement needle bar for the seventh or subsequent sequential sewing number may be indicated by closing a message screen 131 and then pressing the above-described stitch reversing/advancement key 119 to thereby display the seventh and subsequent sequential sewing numbers, the sewing thread information, and the sewing needle bars.

Subsequently, if a CLOSE button 132 on the message screen 131 displayed on the screen 170 is pressed by the user, the process may consider that a thread is replaced in the multi-needle type embroidery sewing machine 11. Then, the process may clear the needle bar thread information piece whose corresponding number of times of thread placement is stored as being 0 out of the needle bar thread information pieces stored in the needle bar thread information storage region 474. The process may then decrease by one (1) from the number of times of thread replacement of each of the needle bar thread information pieces whose number of times of thread replacement is stored as being at least one (1). Subsequently, at step S170 the process may display a screen 180 shown in FIG. 11 that indicates needle bar thread information of a thread to be attached after thread replacement, a sewing needle bar that corresponds to a sequential sewing number, and sewing thread information. On the screen 180, a sewing needle bar that corresponds to a sequential sewing number may be indicated by the sewing needle bar indicator 112 and sewing thread information may be indicated by the sewing order indicator 111. In sewing, before sewing with a thread having sewing thread information of the first sequential number in sewing order, that is, before starting sewing, by performing thread replacement in such a manner as to match the needle bar thread information pieces of, in this Example, "beige, dark brown, reddish brown, black, bright yellow, and white" that are set at S120, it is possible to perform sewing by using the threads having the sewing thread information pieces of the first through sixth sequential numbers in sewing order without suspending it. It should be noted that if thread replacement is unnecessary, the needle bar thread information pieces of the threads already attached to the multi-needle type embroidery sewing machine 11 and the sewing needle bars and sewing thread information that correspond to the sequential sewing numbers are displayed at S170.

Through the above sewing needle bar determination processing, the multi-needle type embroidery sewing machine 11 may instruct a user to replace the thread having the thread information of "yellow" attached to the needle bar "3" with a thread having the thread information of "reddish brown" and also replace the thread having the thread information of "brown" attached to the needle bar "5" with a thread having the thread information of "bright yellow". In this case, the user may sometimes determine that the "yellow" thread attached to the needle bar "3" is similar to the "bright yellow" to be attached to the needle bar "5" after thread replacement and also that the "brown" thread attached to the needle bar "5" is similar to the "reddish brown" to be attached to the needle bar "3" after thread replacement. If a user determines that the "yellow" thread can also be used as the "bright yellow" thread and the "brown" thread can also be used as the "reddish brown" thread, the user can replace the "bright yellow" thread stored as the needle bar thread information corresponding to the needle bar "3" and the "reddish brown" thread stored as the needle bar thread information corresponding to the needle bar "5." Accordingly, the user can perform sewing without replacing the "bright yellow" thread with the "yellow" thread and the "reddish brown" thread with the "brown" thread. The needle bar thread information alteration processing in such a case will be described in greater detail with reference to the flowchart shown in FIG. 12.

First, in step S200, on the screen 180 shown in FIG. 11 where the sewing needle bar indicator 112 determined by the processing shown in FIG. 9 and the post-thread replacement needle bar thread information are displayed on the thread indicators 106, the needle bar thread information alteration key 113 is pressed by the user. As a result, the needle bar thread information alteration screen 120 shown in FIG. 13 may appear in step S210 for performing the needle bar thread information alteration processing. Needle bar number buttons 121, needle bar thread information indicators 122, thread color indicators 123, an alteration button 124, and an OK button 125 may be displayed on the needle bar thread information alteration screen 120. The needle bar number buttons 121 may be used to select a needle bar number that corresponds to the needle bar 27 (see FIGS. 3 and 4). The needle bar thread information indicator 122 may indicate needle bar thread information that corresponds to a needle bar number. The thread color indicator 123 may indicate a thread color of the needle bar thread information in color. The alteration button 124 may be used to instruct a user changing the needle bar thread information. The OK button 125 may be used to end the needle bar thread information alteration processing. Further, at step S210, the selection flag indicating that each needle bar number is selected is stored as the "OFF" state in the selected state storage region 478, to initialize the selected state. It should be noted that in the present embodiment, the needle bar number button 121 corresponding to the needle bar 27 equipped in the multi-needle type embroidery sewing machine 11 is displayed on the LCD 30 and by selecting these needle bar number buttons 121 can be used to select the needle bar 27.

Subsequently, in step S220 the user may select one from the needle bar number buttons 121 for any one of the needle bars "3" and "5" whose needle bar thread information is desired to be changed. In this Example, it is supposed that the needle bar number button 121 for the needle bar "3" is pressed.

At the next step of S230, the process may determine that one needle bar number button 121 is pressed at S220 (YES at S230). Subsequently, at step S250 the process refers to the selected state storage region 478, to determine whether or not the needle bar "3" corresponding to the pressed button is selected. This processing may be performed to determine whether or not to select the pressed needle bar number button 121 and its setting. As described above, the needle bar selection flags corresponding to the needle bars may all be stored as the "OFF" state at S210, so that the process may determine that the needle bar "3" is not in a selected state (NO at S250). It should be noted that if the needle bar number button 121 pressed by the user is determined to be in the selected state (YES at S250), the selection flag of the needle bar corresponding to that needle bar number button 121 is stored as the "OFF" state in the selected state storage region in step S260.

Subsequently, in step S270 the process may refer to the selected state storage region 478, to put the selected needle bar into the selected state on the assumption that a case where the number of the needle bars stored in the selected state already is 0 is determined as a case where a first needle bar is selected. To do so, first the process may determine whether or not the number of the needle bars stored in the selected state is 0. As described above, the number of the needle bars in the selected state is 0 (YES at S270). Therefore, the process may determine that the needle bar "3" is selected by the user at S220 in order to put the needle bar "3" into the selected state. Accordingly, in step S280 the selection flag for the needle bar "3" may be stored as the "ON" state in the selected state storage region 478. Further, to implicitly indicate that the needle bar "3" is in the selected state, an inside of a square of the needle bar button 121 may be hatched in the display like the needle bar number button 121 corresponding to the needle bar "3" on a screen 200 shown in FIG. 14. With this, the user can confirm which needle bar number is in the selected state on the screen 200.

Subsequently, the process returns to S220, where the user may press one needle bar number button 121 for the needle bar "5." In much the same manner as with the case where another needle bar number button 121 for the needle bar "3" is pressed, at the next step of S230 the process may determine that the needle bar number button 121 is pressed at S220 (YES at S230). The process may subsequently refer to the selected state storage region 478, to determine that the needle bar "5" is not in the selected state (NO at S250). Subsequently, the process may refer to the selected state storage region 478 to put the selected needle bar into the selected state on the assumption that a case where the number of the needle bars stored already in the selected state is 1 is determined as a case where the second needle bar is selected. To do so, in step S290 first the process may determine whether or not the number of the needle bars stored in the selected state is 1. The process determines that the selection flag for the needle bar "3" is stored as the "ON" state at S280 and the number of the needle bars in the selected state is 1 (NO at S270 and YES at S290). Subsequently, in step S300 the process may store the selection flag for the needle bar "5" as the "ON" state in the selected state storage region 478. Further, the inside of the square of the needle bar button 121 may be hatched in the display like the needle bar number button 121 corresponding to the needle bar "5" on a screen 200 shown in FIG. 14.

Since it is determined that a suite of the two needle bars "3" and "5" is in the selected state, an arrow 141 may be displayed in step S310 between the needle bars "3" and "5", to point to one of them whose needle bar thread information is to be changed. In Example 1, the needle bar thread information pieces of both of the first and second needle bars may be changed by the needle bar thread information processing, where the arrow 141 points at both of the needle bars "3" and "5". In such a manner, the first needle bar "3" and the second needle bar "5" are connected to each other and needle bars "3" and "5" whose needle bar thread information is desired to be changed are pointed at by the arrow 141. With this, the user can be easy to recognize visually the needle bars "3" and "5" whose needle bar thread information is desired to be changed. It should be noted that this embodiment is configured to enable selection of up to two needle bars. Therefore, if the first and second needle bars are already selected to provide two selected states at step S290, a further needle bar different from them being selected may be determined to be an error, so that the process does not put the needle bar having the further selected needle bar number into the selected state and returns to S220.

After step S310, the process may return to S220, where the user may press the alteration button 124 at step 220. In this embodiment, when the alteration button 124 is pressed, the process may store needle bar thread information corresponding to the first needle bar selected at S220 as that corresponding to the second needle bar in the needle bar thread information storage region 474. Further, when the alteration button 124 is pressed, the process may store needle bar thread information corresponding to the second needle bar as that corresponding to the first needle bar in the needle bar thread information storage region 474. The alteration button 124 may thus be used to instruct processing to change the needle bar thread information pieces corresponding to the first needle bar and the second needle bar respectively. If having determined that the alteration button 124 is selected by the user (NO at S230 and YES at S240), the process may refer to the selected state storage region 478 in order to identify the needle bar subject to alteration. Then, in step S350 the process may determine whether or not there are two needle bars in the selected state and may identify the two needle bars of the first needle bar "3" and the second needle bar "5" in the selected state (YES at S350).

Subsequently, the process may store the needle bar thread information "reddish brown" corresponding to the first needle bar selected at S220 as the needle bar thread information corresponding to the second needle bar in the needle bar thread information storage region 474. Further, the needle bar thread information "bright yellow" corresponding to the second needle bar may be stored as the needle bar thread information corresponding to the first needle bar in the needle bar thread information storage region 474. As a result, in step S360 the needle bar thread information pieces corresponding to the first needle bar and the second needle bar may be changed respectively.

Subsequently, in step S370 the needle bars "3" and "5" whose needle bar thread information pieces are changed at S360 may be stored in the alteration history storage region 479. This alteration history will be referred to in the later-described re-determination of the sewing needle bars. Subsequently, in step S380 to initialize the selected state of the needle bars on which the needle bar thread information alteration processing is finished, the selected states of the needle bars "3" and "5" may be stored as the "OFF" state in the selected state storage region 478.

Subsequently, the process returns to S210, where the needle bar information changed at S360 may be indicated by the needle bar thread information indicator 122 on the needle bar thread information alteration screen 120. This processing makes it possible to confirm the needle bar thread information after the needle bar thread information alteration processing. Subsequently, in step S220 if the user presses the OK button 125 to end the needle bar thread information alteration processing, the process may determine that the OK button 125 is pressed (NO at S230 and NO at S240), to end the processing.

With this, the needle bar thread information corresponding to the needle bar "3" and that corresponding to the needle bar "5" may be changed to those of "bright yellow" and "reddish brown" respectively. Subsequently, the process may perform processing to redetermine a sewing order, based on the post-alteration needle bar thread information. The processing to re-determine the sewing needle bars is performed when the OK button 125 is pressed at the above-described step of S220.

The processing to redetermine the sewing needle bars may proceed as follows. According to a sewing order determined before alteration of the needle bar thread information, the sequential sewing order number "3, 5, 2, 6, 1, and 4" is assigned to the sewing needle bars as indicated by the sewing needle bar indicators 112 in FIG. 11, whose sewing order may be stored in the sewing thread information storage region 473 already. Out of these, the needle bars "3" and "5" have their needle bar thread information changed. Therefore, the process may refer to the alteration history storage region 479 and the sewing thread information storage region 473 in which sewing needle bars may be stored as correlated with the sewing order and the sewing thread information. Then, the needle bars "3" and "5" whose needle bar numbers have been changed are replaced with each other, so that the needle bar numbers of the sewing needle bars corresponding to the sewing order may be stored as being "5, 3, 2, 6, 1, and 4" as the sequential sewing order numbers in the sewing thread information storage region 473. Concurrently, the needle bar numbers of the sewing needle bars may be displayed on the LCD 30 as indicated by the sewing needle bar indicator 112 in FIG. 15.

The above processing completes all the processes of performing, as Example 1, the sewing needle bar determination processing to determine a sewing needle bar and a replacement needle bar which may be used in sewing the above-described embroidery pattern 100, the needle bar thread information replacement processing, and the sewing needle bar determination processing again (i.e., after replacement). It should be noted that the above-described Example 1 employs the thread information pieces of "beige, dark brown, yellow, black, brown, and white" of the threads actually attached to the needle bars but the multi-needle type embroidery sewing machine 11 stores the needle bar thread information pieces of "beige, dark brown, bright yellow, black, dark brown, and white" of the threads attached to the needle bars 27 (see FIGS. 3 and 4), so that they do not agree. Therefore, after the embroidery pattern 100 is sewn, it may be preferable to perform the processing of returning the needle bar thread information pieces set to the needle bars 27 stored in the multi-needle type embroidery sewing machine 11 to the needle bar thread information pieces of "beige, dark brown, yellow, black, brown, and white" of the threads actually attached to the needle bars. Although this processing has been performed so as to, if the CLOSE button 132 of the message 131 on the screen 170 shown in FIG. 10 is pressed by the user in the present embodiment, for example, the process considers that a thread has been replaced in the multi-needle type embroidery sewing machine 11 and may clear such a needle bar thread information piece that the corresponding number of times of thread replacement is stored as being 0 out of the needle bar thread information pieces stored in the needle bar thread information storage region 474. However, may also be configured so that past needle bar thread information is capable of being recalled after sewing.

In the above-described multi-needle type embroidery sewing machine 11, the needle bar thread information corresponding to the first needle bar may be stored as the needle bar thread information corresponding to the second needle bar and, conversely, the needle bar thread information corresponding to the second needle bar may be stored as the needle bar thread information corresponding to the first needle bar. Accordingly, it is possible to easily change a relationship between the needle bars 27 and the thread information stored in the multi-needle type embroidery sewing machine 11. Further, based on the needle bar thread information after being changed by the user, a sewing needle bar determined by the CPU 45 can be obtained as a post-alteration sewing needle bar. Therefore, for example, a thread set to one of the needle bars 27 different from the other needle bars 27 which is instructed to need thread replacement can also be used as a thread having thread information specified by the multi-needle type embroidery sewing machine 11. With this, it is possible through calculations to continuously perform sewing without any thread replacement, if desired, by the user changing a relationship between a sewing order and the needle bars 27 obtained by the multi-needle type embroidery sewing machine 11. Further, if, for example, two threads are attached to the needle bars not instructed by the multi-needle type embroidery sewing machine 11, sewing can be performed without performing thread replacement again by changing the needle bar thread information stored in the multi-needle type embroidery sewing machine 11.

Further, the embodiment described above has selected the needle bar numbers that correspond to the needle bars 27 displayed on the LCD 30 to thereby specify those needle bars whose thread information is wished to be changed as the first needle bar and the second needle bar. Then, by confirming the needle bars 27 determined by the multi-needle type embroidery sewing machine 11 and the needle bar thread information pieces corresponding to these needle bars 27, one needle bar 27 whose needle bar thread information is desired to be changed can be selected by pressing one of the needle bar number buttons 121 that corresponds to this needle bar 27. Also, since the needle bar 27 that needs thread replacement has been determined and the corresponding needle bar number has been displayed on the LCD 30, it is possible to confirm the thread information of a thread attached to the needle bar 27 determined to need thread replacement and select the needle bar whose needle bar thread information is desired to be changed. It is thus possible to perform sewing without performing thread replacement as much as possible as desired by the user.

Further, since the thin-model LCD 30 may be used in display, only a small space is required to install it and, further, items may be displayed clearly. Also, since the transparent touch panel 32 which may be used in front of the LCD 30 is used as an optional input device, by referring to the displayed content on the LCD 30, it is possible to easily select the first and second needle bars on the touch panel 32. Those first and second needle bars selected on the touch panel 32 may be displayed as well as a mark that may indicate a needle bar whose needle bar thread information is to be changed. Accordingly, it is possible to easily understand visually which needle bars are selected as the first and second needle bars or which needle bar is to have its needle bar thread information changed. Further, as shown by the needle bar thread information alteration screen 120 shown in FIG. 14, the needle bar number buttons 121 that correspond to the first and second needle bars respectively may be connected and such a needle bar number button 121 as to correspond to the needle bar 27 whose needle bar thread information is to be changed may be pointed at by the arrow 141. Accordingly, it is possible to easily recognize visually the needle bar 27 whose needle bar thread information is desired to be changed. Also, since thread information may contain thread colors, as by the thread color indicator 123 shown in FIGS. 12 and 13, for example, a thread color can be displayed to visually determine whether or not thread replacement is necessary, by using the thread color.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles For example, although the above embodiment has been described with reference to Example 1 where the thread information is composed of thread colors only to simplify the description, the present disclosure is not limited to it; information indicative of thread attributes such as a manufacturer's name, a name, a thickness, and a material may be applied as the thread information.

Although embodiment described above has used the LCD 30, the present disclosure is not limited to this feature; any other display device such as a plasma display may be used. Further, the present disclosure is not limited to the screen of the present embodiment; contents, designs, shapes, a layout, etc. of the various buttons displayed on the LCD 30 can be changed according to the functions of the multi-needle type embroidery sewing machine, a size used in the LCD 30, display characteristics, etc.

Although the embodiment described above has selected the needle bars using the touch panel 32, the present disclosure is not limited to this feature; it is possible to adopt various switches, a track ball or mouse, a voice input system, or any other interface with the operator.

Further, although the embodiment described above has assumed a needle bar corresponding to a needle bar number selected first to be a first needle bar and a needle bar corresponding to a needle bar number selected secondly to be a second needle bar, the first and second needle bars may be set irrespective of an order in which to select the needle bar numbers because thread information pieces of the first and second needle bars will be replaced with each other in the present embodiment. Also, an input area may be provided to input the first and second needle bars respectively so that their needle bar numbers may each be input there.

Further, in the embodiment described above, the needle bar thread information storage region 474 has not only stored thread information of a thread set into the multi-needle type embroidery sewing machine 11 as needle bar thread information but also stored thread information of a thread expected to be set into the multi-needle type embroidery sewing machine 11 in sewing as needle bar thread information; however, optionally, only the thread information of the thread set into the multi-needle type embroidery sewing machine 11 may be stored as the needle bar thread information.

Further, in the embodiment described above, after the CPU 45 has determined a sewing needle bar and set needle bar thread information, the needle bar thread information set by the CPU 45 has been displayed on the LCD 30 so that a first needle bar and a second needle bar might be selected from among the displayed needle bars. However, it is possible to omit processing to determine the sewing needle bar or display the determined needle bar on the LCD 30 prior to selection of the first and second needle bars.

Further, the embodiment described above displays a replaced needle bar on the LCD 30 at S160 shown in FIG. 9; however, this processing can be omitted. Also, a manner in which to display the replacement needle bar on the LCD 30 is not limited to that of the embodiment described above as far as it enables to identify the replacement needle bar. Therefore, for example, a display field which collectively displays replacement needle bars may be provided, to indicate their needle bar numbers therein. Also, in the embodiment described above, the CPU 45 determines a sewing needle bar based on needle bar thread information changed by it; however, this processing can also be omitted.

Further, the CPU 45 is not limited to embodiment described above as far as it can determine a sewing needle bar. Therefore, although in the embodiment described above, for example, the thread information storage region 475 has been configured to be capable of storing thread information pieces as many as the number of the needle bars N, the present disclosure is not limited to this feature; an arbitrary value not larger than the number of the needle bars N may be used to determine a sewing needle bar. Also, for example, a sewing needle bar may be determined by comparing sewing thread information pieces such as the number of the needle bars read as many as a predetermined number with the needle bar thread information. Further, although in the embodiment described above, when redetermining a sewing needle bar with the CPU 45, sequential sewing order numbers of such needle bars out of the sewing needle bars determined by the CPU 45 as to have their needle bar thread information changed by the CPU 45 have been replaced with each other, the sewing needle bars may be determined by the same manner as with the CPU 45. In such a case, the processing of S370 shown in FIG. 12 can be omitted. Also, the embodiment described above performs the processing to determine sewing needle bars again when the OK button 125 has been pressed at S220. However, the present disclosure is not limited to it; for example, a button instructing a process to redetermine sewing needle bars may be provided so that when this button is pressed, processing to redetermine the needle bars may be performed.

Further, in the embodiment described above, as shown in FIG. 14, the first needle bar and the second needle bar selected by the user are indicated on the LCD 30 in such a manner that they could be distinguished from the other needle bars and, further, between the first and second needle bars the arrow 141 is displayed to point to a needle bar number of the needle bar whose needle bar thread information would be changed. However, such display can also be omitted. Further, in the above described embodiment, the first and second needle bars are hatched in the display in order to clearly indicate that they are in the selected state. However, a display method is not limited to it as far as they are preferably distinguished from the other needle bars. For example, it is possible to employ highlighting of a selected needle bar number, blinking of a needle bar number, alteration of a typestyle or a format such as underlining, drawing of a profile, reversing of display, displaying of an arrow or an indicator finger, alteration of a color of a character or a background, indication of a mark, etc. Also, a field to display the first and second needle bars may be provided to indicate needle bar numbers of the first and second needle bars. Further, the embodiment described above has identified a plurality of needle bars of the multi-needle type embroidery sewing machine 11 by their needle bar numbers. However, the present disclosure is not limited to it; a character or a symbol may be used which can identify the needle bars.

Further, in the embodiment described above as for the first needle bar and the second needle bar selected by the user, the CPU 45 stores in the needle bar thread information storage region 474 needle bar thread information corresponding to the first needle bar as that corresponding to the second needle bar and also stores in the needle bar thread information storage region 474 needle bar thread information corresponding to the second needle bar at the time of the selection as that corresponding to the first needle bar, thereby changing the needle bar thread information pieces that correspond to the first needle bar and the second needle bar respectively. However, as in the case of the embodiment described below, it is possible to store the needle bar thread information corresponding to the first needle bar as that corresponding to the second needle bar in the needle bar thread information storage region 474, thereby changing only the needle bar thread information corresponding to the second needle bar.

Figure 16:
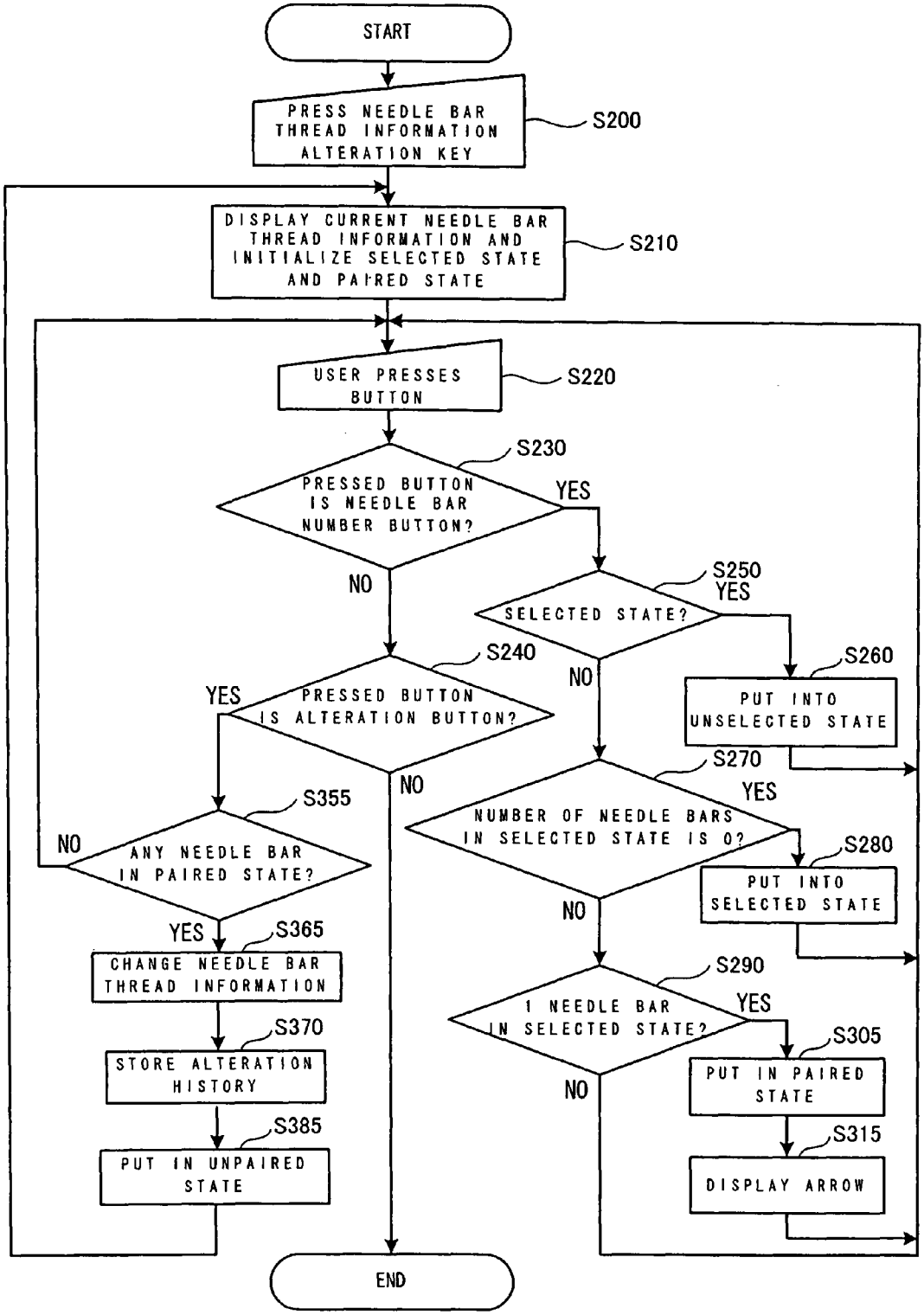
FIG. 16 is a flowchart showing a flow of the needle bar thread information alteration processing according to another embodiment.
Figure 17:
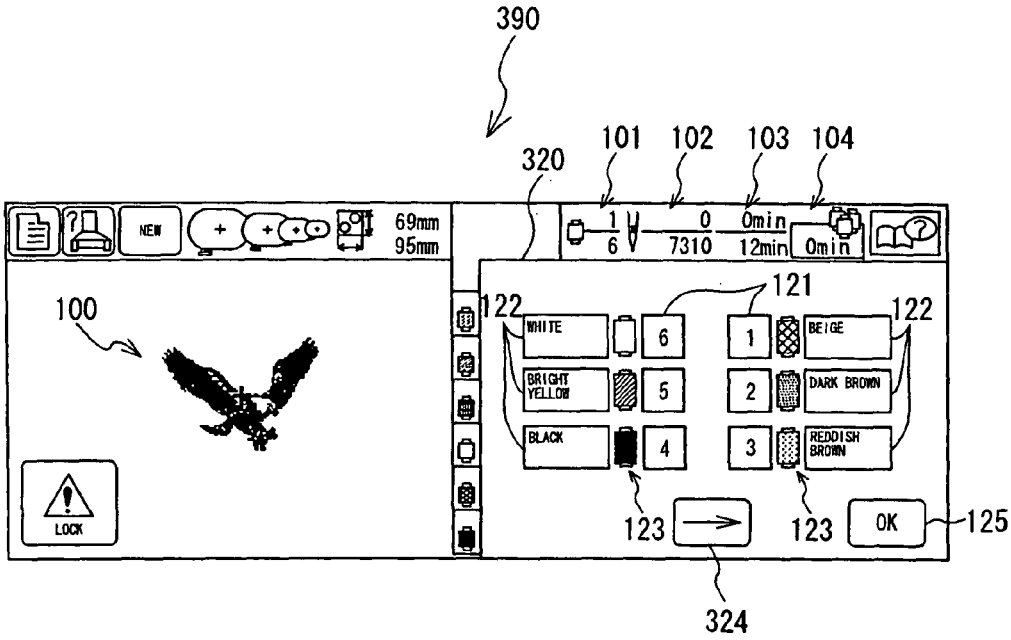
FIG. 17 is an illustration of the needle bar thread information alteration screen displayed on the front surface of the screen.
Figure 18:
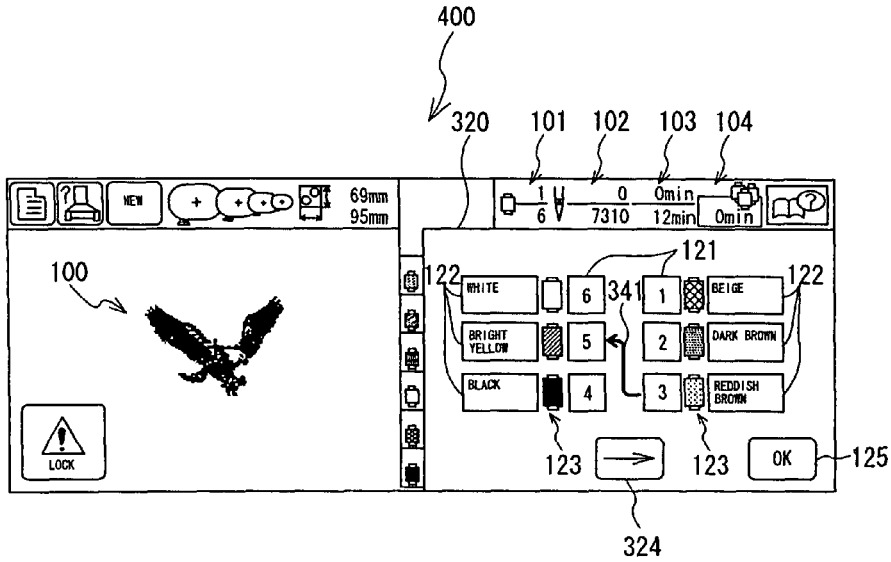
FIG. 18 is an illustration of the needle bar thread information alteration screen on which arrows are displayed.

The following will describe the embodiment of the needle bar thread information alteration processing of changing of only the needle bar thread information corresponding to the second needle bar, with reference to FIGS. 16 through 18. It should be noted that a program to perform the needle bar thread information alteration processing according to the embodiment shown in FIG. 16 is stored already in the multi-needle type embroidery sewing machine program storage region 465 (see FIG. 5) in the ROM 46 and executed by the CPU 45 shown in FIG. 4.

As in the case of Example 1 described in the above embodiment, if the sewing needle bars are set as indicated by the sewing needle bar indicator 112 and the needle bar thread information is set as indicated by the thread indicators 106 in FIG. 11, the needle bar thread information of "reddish brown" stored as the needle bar thread information corresponding to the needle bar "3" may be replaced with the needle bar thread information of "bright yellow" stored as the needle bar thread information corresponding to the needle bar "5".

The needle bar thread information alteration processing in accordance with another embodiment stores the needle bar thread information corresponding to the first needle bar as that of the second needle bar, thereby changes the needle bar thread information of the second needle bar. Accordingly, in this embodiment, to perform the processing to replace the needle bar thread information of the first needle bar "3" and that of the second needle bar "5" with each other, it is necessary to select two suites of a needle bar suite composed of the first needle bar "3" and the second needle bar "5" and another needle bar suite composed of the first needle bar "5" and the second needle bar "3". With this, first in step S200, as in the case of the above-described embodiment, the user may press the needle bar thread information alteration key 113 on the screen 180 shown in FIG. 11 given by the sewing needle bar indicator 112 determined by the processing shown in FIG. 9 and the thread indicators 106 indicating post-thread replacement needle bar thread information, to display a needle bar thread information alteration screen 320 to perform the needle bar thread information alteration processing in step S210. The needle bar thread information alteration screen 320 may display the needle bar number buttons 121 to select a needle bar number, the needle bar thread information indicators 122 corresponding to a needle bar number, the thread color indicators 123 to indicate a thread color in the needle bar thread information in color, an alteration button 324 to instruct change of the needle bar thread information, and the OK button 125 to end the needle bar thread information alteration processing. Further, on the needle bar thread information alteration screen 320, the selection flag for each of the needle bars may be stored as the "OFF" state in the selected state storage region 478, to initialize the state of the needle bar. Moreover, a paired state region (not shown) may be cleared which may store the needle bar numbers of the first and second needle bars for each needle bar suite, thereby initializing the paired state in step S210.

Subsequently, in step S220 as in the case of the above-described embodiment, the user may press the needle bar number button 121 that corresponds to the needle bar "3", thus selecting a needle bar. Then, the process may determine that the needle bar number button 121 has been selected (YES at S230). The process accordingly may determine that the needle bar "3" is not in the selected state (NO at S250). Subsequently, the process may refer to the selected state storage region 478, to determine that the number of the needle bars stored as being in the selected state is 0 (YES at S270). Then, the needle bar "3" may be selected as the first needle bar and stored as being in the selected state in the selected state storage region 478, and to indicate that the needle bar "3" is in the selected state, the inside of the square of the needle bar number button 121 may be hatched in the display in step S280. In such a manner, in this embodiment, the process may recognize the needle bar number button corresponding to the first needle bar has been pressed in a condition where the number of the needle bars in the selected state is 0.

Subsequently, the process may return to S220, where the user may press the needle bar number button 121 corresponding to the needle bar "5" so that as in the case where the needle bar "3" is selected, the process may determine that the needle bar number button 121 is pressed (YES at S230) and that the needle bar "5" is not in the selected state (NO at S250). Subsequently, the process may refer to the selected state storage region 478, to determine that the number of the needle bars in the selected state is one (1) (NO at S270) because only the needle bar "3" is stored as being in the selected state. Since the needle bar number button 121 corresponding to the needle bar "5" is pressed by the user, the process may determine that the needle bar "5" is selected as the second needle bar. Then, in step S305 the process may store in the paired state storage region, not shown, the needle bar numbers of the needle bar "3" already in the selected state and the newly selected needle bar "5" as the first needle bar and the second needle bar respectively. Then, the selection flag of the needle bar "3" is stored as the "OFF" state in the selected state storage region 478. The two states of the selected state and the paired state are thus prescribed in order to enable selection of a suite of a plurality of the needle bars whose needle bar thread information is to be changed.

Subsequently, in step S315 as shown in FIG. 18, an arrow 341 that points at the second needle bar "5" whose needle bar thread information is to be changed may be displayed between the needle bar number button 121 corresponding to the needle bar "3" and another needle bar number button 121 corresponding to the needle bar "5" (S315). The arrow 341 serves to implicitly indicate the needle bar "5" whose needle bar thread information is to be changed and that the first needle bar "3" and the second needle bar "5" are selected. Since the arrow 341 is thus used to connect the first needle bar "3" and the second needle bar "5" to each other and point at the needle bar number button 121 corresponding to the needle bar "5" whose needle bar thread information is to be changed, it is possible to easily recognize visually the needle bar whose needle bar thread information is to be changed.

Subsequently, in step S305 in order to select another suite of the needle bars, the process selects the needle bar "5" as the first needle bar and the needle bar "3" as the second needle bar (S220) and puts them into the paired state.

Subsequently, in step S220 an alteration button 324 may be pressed by the user. The alteration button 324 may be used to instruct storing of the needle bar thread information corresponding to the first needle bar selected at S220 as that corresponding to the second needle bar in the needle bar thread information storage region 474 and changing the needle bar thread information corresponding to the second needle bar. The process may determine that the alteration button 324 is selected by the user (NO at S230 and YES at S240). Subsequently, in step S355 the process may refer to the paired state storage region, not shown, to determine whether or not any needle bar 27 is in the paired state. Two suites of the needle bar pair of needle bar "3" as the first needle bar and needle bar "5" as the second needle bar and the needle bar pair of needle bar "5" as the first needle bar and needle bar "3" as the second needle bar may be stored in the paired state storage region (YES at S355), which may be followed by alteration of the needle bar thread information in step S365. At this step of S365, in the needle bar thread information alteration processing on the suite of needle bar "3" as the first needle bar and needle bar "5" as the second needle bar, the needle bar thread information of "reddish brown" corresponding to needle bar "3" may be stored as the needle bar thread information corresponding to the needle bar "5". On the other hand, in the needle bar thread information alteration processing on the suite of the needle bar "5" as the first needle bar and needle bar "3" as the second needle bar, the needle bar thread information of "bright yellow" corresponding to the needle bar "5" may be stored as the needle bar thread information corresponding to the needle bar "3".

Subsequently, in step S370 to store the needle bar whose needle bar thread information has been changed at S365, the process stores the needle bars "3" and "5" in the alteration history storage region 479. This alteration history will be referred to when redetermining a sewing needle bar as described above. Subsequently, in step S385 to initialize the paired state of the needle bars on which the needle bar thread information alteration processing is finished, the paired state storage region (not shown) is cleared.

Subsequently, the process may return to S210, where the needle bar thread information after being changed at S365 may be displayed on the screen and, when the OK button 125 is pressed by the user to finish the alteration (S220), the process may determine that the OK button 125 is pressed (NO at S230 and NO at S240), to end the needle bar thread information alteration processing in accordance with another embodiment.

With this, "reddish brown" stored as the needle bar thread information corresponding to the needle bar "3" and "bright yellow" stored as the needle bar thread information corresponding to the needle bar "5" may be changed to store the "bright yellow" as the needle bar thread information pieces corresponding to the needle bar "3" and the "reddish brown" as that corresponding to the needle bar "5" respectively in the needle bar thread information storage region 474.

By the multi-needle type embroidery sewing machine in accordance with this embodiment, it is possible to change thread information by one alteration operation even if there are an odd number of needle bars whose needle bar thread information is to be stored desirably.

Although in the above embodiment, only up to two needle bars could have been selected by the processing at S290 shown in FIG. 12, such a configuration may be employed as to prescribe the selected state and the paired state, thereby enabling selection of a suite of a plurality of the needle bars as in the case of other embodiments. Also, such configuration may be employed as to enable selection of the needle bar thread information alteration processing of the first-described embodiment and that of the later described embodiment.

According to a multi-needle type embroidery sewing machine and a control program for the same of the present disclosure, it is possible to store the needle bar thread information corresponding to the first needle bars that constitute a plurality of the needle bars as that corresponding to a second needle bar, thereby changing a relationship between the needle bars and the thread information that is stored in the multi-needle type embroidery sewing machine. Accordingly, for example, even if a thread is set mistakenly to a needle bar different from a needle bar specified by the multi-needle type embroidery sewing machine, by changing the needle bar thread information, sewing can be performed appropriately without replacing the thread again.

What is claimed is:

1. A multi-needle type embroidery sewing machine comprising:

a plurality of needle bars;

a needle bar thread information storage device that stores needle bar thread information about threads which are set to the needle bars;

a needle bar selection device that selects at least one suite of two needle bars including a first needle bar and a second needle bar selected from the plurality of needle bars; and a control device that:

stores in the needle bar thread information storage device needle bar thread information that corresponds to the first needle bar selected by the needle bar selection device as needle bar thread information that corresponds to the second needle bar, thereby changing at least the needle bar thread information that corresponds to the second needle bar;

stores the needle bar thread information corresponding to the first needle bar as the needle bar thread information corresponding to the second needle bar in the needle bar thread information storage device at the time of being selected by the needle bar selection device;

stores the needle bar thread information corresponding to the second needle bar as the needle bar thread information corresponding to the first needle bar in the needle bar thread information storage device at the time of being selected by the needle bar selection device; and changes the needle bar thread information corresponding to the first needle bar and changes the needle bar thread information corresponding to the second needle bar.

2. The multi-needle type embroidery sewing machine according to claim 1, further comprising:

a sewing thread information storage device that stores sewing thread information including information about a thread used to sew an embroidery pattern and a sequential sewing order number correlating to the sewing thread information;

wherein the control device compares the sewing thread information stored in the sewing thread information storage device and the sequential sewing order number with the needle bar thread information after storing the needle bar thread information and after changing the needle bar thread information corresponding to the second needle bar, thereby determining a sewing needle bar which corresponds to the sequential sewing order number.

3. The multi-needle type embroidery sewing machine according to claim 1, further comprising:

a sewing thread information storage device that stores sewing thread information including information about a thread used to sew an embroidery pattern and a sequential sewing order number correlating to the sewing thread information; and a display device that displays information about sewing by the multi-needle type embroidery sewing machine, wherein the control device:

compares the sewing thread information stored in the sewing thread information storage device and the sequential sewing order number with the needle bar thread information before changing the needle bar thread information corresponding to the second needle bar, thereby determining a sewing needle bar;

stores the sewing thread information corresponding to the determined sewing needle bar in the needle bar thread information storage device as the needle bar thread information corresponding to the sewing needle bar, and sets the needle bar thread information that corresponds to said sewing needle bar; and identifies on the display device a needle bar and the set needle bar thread information that corresponds to this needle bar; and wherein the needle bar selection device selects the first needle bar and the second needle bar from among the plurality needle bars and needle bar thread information that corresponds to the first and second needle bars which are displayed on the display device.

4. The multi-needle type embroidery sewing machine according to claim 3, wherein the control device:

determines a replacement needle bar, which is a sewing needle bar that needs thread replacement, from among the determined sewing needle bars; and identifies the determined replacement needle bar on the display device.

5. The multi-needle type embroidery sewing machine according to claim 3, wherein the display device includes a liquid crystal display.

6. The multi-needle type embroidery sewing machine according to claim 5, wherein the needle bar selection device is an optional input device including a transparent touch panel disposed in a front surface of the liquid crystal display.

7. The multi-needle type embroidery sewing machine according to claim 3, wherein the control device displays the first needle bar and the second needle bar selected by the needle bar selection device on the display device, and also displays a mark that indicates the needle bar that has the needle bar thread information changed on the display device.

8. The multi-needle type embroidery sewing machine according to claim 7, wherein the mark is an arrow that connects the first needle bar and the second needle bar displayed on the display device and points to the needle bar that has the needle bar thread information changed.

9. The multi-needle type embroidery sewing machine according to claim 2, wherein the needle bar thread information and the sewing thread information each contain at least thread color information.

10. The multi-needle type embroidery sewing machine according to claim 2, wherein the needle bar thread information and the sewing thread information each contain at least information of a name of a manufacturer of the thread.

11. The multi-needle type embroidery sewing machine according to claim 2, wherein the needle bar thread information and the sewing thread information each contain at least information of a material of the thread.

12. A computer-readable storage medium including a computer control program for multi-needle type embroidery sewing machine, where the program comprises:

needle bar thread information storage instructions for storing needle bar thread information about threads which are set to needle bars;

needle bar selection instructions for selecting at least one suite of two needle bars including a first needle bar and a second needle bar selected from a plurality of the needle bars;

needle bar thread information alteration instructions for storing needle bar thread information that corresponds to the first needle bar selected during execution of the needle bar selection instructions, as needle bar thread information that corresponds to the second needle bar, thereby changing at least the needle bar thread information that corresponds to the second needle bar;

instructions for storing the needle bar thread information corresponding to the first needle bar as the needle bar thread information corresponding to the second needle bar during execution of the needle bar selection instructions;

instructions for storing the needle bar thread information corresponding to the second needle bar as the needle bar thread information corresponding to the first needle bar during the execution of the needle bar selection instructions; and instructions for changing the needle bar thread information corresponding to the first needle bar and changing the needle bar thread information corresponding to the second needle bar.

13. The computer-readable storage medium according to claim 12, further comprising:

sewing thread information storage instructions for storing sewing thread information including information about a thread used to sew an embroidery pattern and a sequential sewing order number correlating to the sewing thread information; and sewing needle bar determination instructions for comparing the sewing thread information stored during execution of the sewing thread information storage instructions and the sequential sewing order number with the needle bar thread information after storing the needle bar thread information and after changing the needle bar thread information corresponding to the second needle bar during execution of the needle bar thread information alteration instructions, thereby determining a sewing needle bar which corresponds to the sequential sewing order number.

14. The computer-readable storage medium according to claim 12, further comprising:

sewing thread information storage instructions for storing sewing thread information including information about a thread used to sew an embroidery pattern and a sequential sewing order number correlating to the sewing thread information;

sewing needle bar determination instructions for comparing the sewing thread information stored during execution of the sewing thread information storage instructions and the sequential sewing order number with the needle bar thread information before changing the needle bar thread information corresponding to the second needle bar during execution of the needle bar thread information alteration instructions, thereby determining a sewing needle bar;

needle bar thread information setting instructions for storing the sewing thread information corresponding to the sewing needle bar determined during execution of the sewing needle bar determination instructions as the needle bar thread information corresponding to the sewing needle bar, and setting the needle bar thread information that corresponds to the sewing needle bar; and needle bar display control instructions for identifying the needle bar and the set needle bar thread information that corresponds to this needle bar on a display device, wherein the needle bar selection instructions include instructions for selecting the first needle bar and the second needle bar from among the plurality of needle bars and the needle bar thread information that corresponds to the selected needle bars, wherein the program includes instructions for identifying the selected needle bars on the display device.

15. The computer-readable storage medium according to claim 14, further comprising:

replacement needle bar determination instructions for determining a replacement needle bar, which is a sewing needle bar that needs thread replacement, from among the sewing needle bars determined during execution of the sewing needle bar determination instructions; and replacement needle bar display control instructions for identifying the replacement needle bar determined during execution of the replacement needle bar determination instructions on the display device.

16. The computer-readable storage medium according to claim 14, comprising:

selected needle bar display control instructions for identifying the first needle bar and the second needle bar selected during execution of the needle bar selection instructions on the display device and also instructions for displaying a mark that indicates the needle bar that has the needle bar thread information changed on the display device.

17. The computer-readable storage medium according to claim 16, wherein the mark is an arrow that connects the displayed first and second needle bars and points to the needle bar that has the needle bar thread information changed.

18. The computer-readable storage medium according to claim 13, wherein the needle bar thread information and the sewing thread information each contain at least thread color information.

19. The computer-readable storage medium according to claim 13, wherein the needle bar thread information and the sewing thread information each contain at least information of a name of a manufacturer of the thread.

20. The computer-readable storage medium according to claim 13, wherein the needle bar thread information and the sewing thread information each contain at least information of a material of the thread.

* * * * *